US010129666B2

(12) United States Patent
Gustafsson et al.

(10) Patent No.: US 10,129,666 B2
(45) Date of Patent: Nov. 13, 2018

(54) SIGNAL CONDUCTING COUPLING

(71) Applicant: Cochlear Limited, Macquarie University, NSW (AU)

(72) Inventors: Johan Gustafsson, Mölnlycke (SE); Marcus Andersson, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 650 days.

(21) Appl. No.: 14/568,822

(22) Filed: Dec. 12, 2014

(65) Prior Publication Data

US 2015/0312686 A1 Oct. 29, 2015

Related U.S. Application Data

(60) Provisional application No. 61/985,755, filed on Apr. 29, 2014.

(51) Int. Cl.
*H04R 25/00* (2006.01)

(52) U.S. Cl.
CPC ..... *H04R 25/606* (2013.01); *H04R 2225/63* (2013.01); *H04R 2460/13* (2013.01)

(58) Field of Classification Search
CPC ..... H04R 2225/63; H04R 2460/13; H04R 25/606
See application file for complete search history.

(56) References Cited

U.S. PATENT DOCUMENTS

| | | | | |
|---|---|---|---|---|
| 4,498,461 | A | 2/1985 | Hakansson | |
| 5,735,790 | A | 4/1998 | Hakansson et al. | |
| 7,021,676 | B2 | 4/2006 | Westerkull | |
| 2004/0210103 | A1 | 10/2004 | Westerkull | |
| 2006/0015155 | A1* | 1/2006 | Charvin | H04R 25/606 607/57 |
| 2009/0105523 | A1* | 4/2009 | Kassayan | A61C 7/00 600/25 |
| 2013/0018218 | A1* | 1/2013 | Haller | H04R 25/60 600/25 |
| 2013/0114834 | A1 | 5/2013 | Bern | |

* cited by examiner

*Primary Examiner* — Christine H Matthews
(74) *Attorney, Agent, or Firm* — Pilloff & Passino LLP; Martin J. Cosenza

(57) ABSTRACT

A device including a prosthesis including an external component configured to output a signal in response to an external stimulus and a skin penetrating component configured to communicatively transfer the signal at least partially beneath skin of the recipient, wherein the device is configured such that the skin penetrating component can move in a plurality of degrees of freedom relative to the external component while retained to the external component.

34 Claims, 36 Drawing Sheets

SIGNAL CONDUCTING COUPLING

CROSS-REFERENCE TO RELATED APPLICATIONS

This application claims priority to Provisional U.S. Patent Application No. 61/985,755, entitled PERCUTANEOUS VIBRATION CONDUCTOR, filed on Apr. 29, 2014, naming Marcus ANDERSSON as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, certain types of hearing prostheses commonly referred to as bone conduction devices, convert a received sound into mechanical vibrations. The vibrations are transferred through the skull to the cochlea causing generation of nerve impulses, which result in the perception of the received sound. Bone conduction devices may be a suitable alternative for individuals who cannot derive sufficient benefit from acoustic hearing aids.

SUMMARY

In an exemplary embodiment, there is a device, comprising a prosthesis including an external component configured to output a signal in response to an external stimulus and a skin penetrating component configured to communicatively transfer the signal at least partially beneath the skin of the recipient, wherein the device is configured such that the skin penetrating component can move in a plurality of degrees of freedom relative to the external component while retained to the external component.

In another exemplary embodiment, there is a device comprising a prosthesis including an external component configured to output a signal in response to an external stimulus, and a skin penetrating component configured to communicatively transfer the signal at least partially beneath the skin of the recipient, wherein the device is configured such that the skin penetrating component can move in a plurality of degrees of freedom relative to the external component while retained to the external component.

In another exemplary embodiment, there is a device comprising a prosthesis including an external component configured to output a signal in response to an external stimulus, and a conductor component coupled to the external component configured to communicatively transfer the signal at least one of to a location at or below skin of the recipient, wherein the conductor component is coupled to the external component via a sliding coupling. In an exemplary embodiment, the external component is a BTE device.

In another exemplary embodiment, there is a device comprising a prosthesis, where the prosthesis includes an external component including a first side configured to output a signal in response to an external stimulus, and a conductor component coupled to the external component configured to communicatively transfer the signal at least one of to a location at or below skin of the recipient, wherein the device is configured such that the conductor component can be coupled to the external component of at least one of a plurality of locations on the first side or in a plurality of orientations at a given location on the first side.

In at least some exemplary embodiments, the external device is a left/right compatible BTE device, the external device includes a first array of magnets arrayed about a first side of the BTE device, the external device includes a second array of magnets arrayed about a second side of the BTE device opposite to the first side, wherein the respective arrays of magnets establishes a magnetic coupling between the BTE device and the conductor component when the conductor component is proximate the respective array of magnets.

BRIEF DESCRIPTION OF THE DRAWINGS

Embodiments of the present invention are described below with reference to the attached drawings, in which.

DETAILED DESCRIPTION

Figure 1:
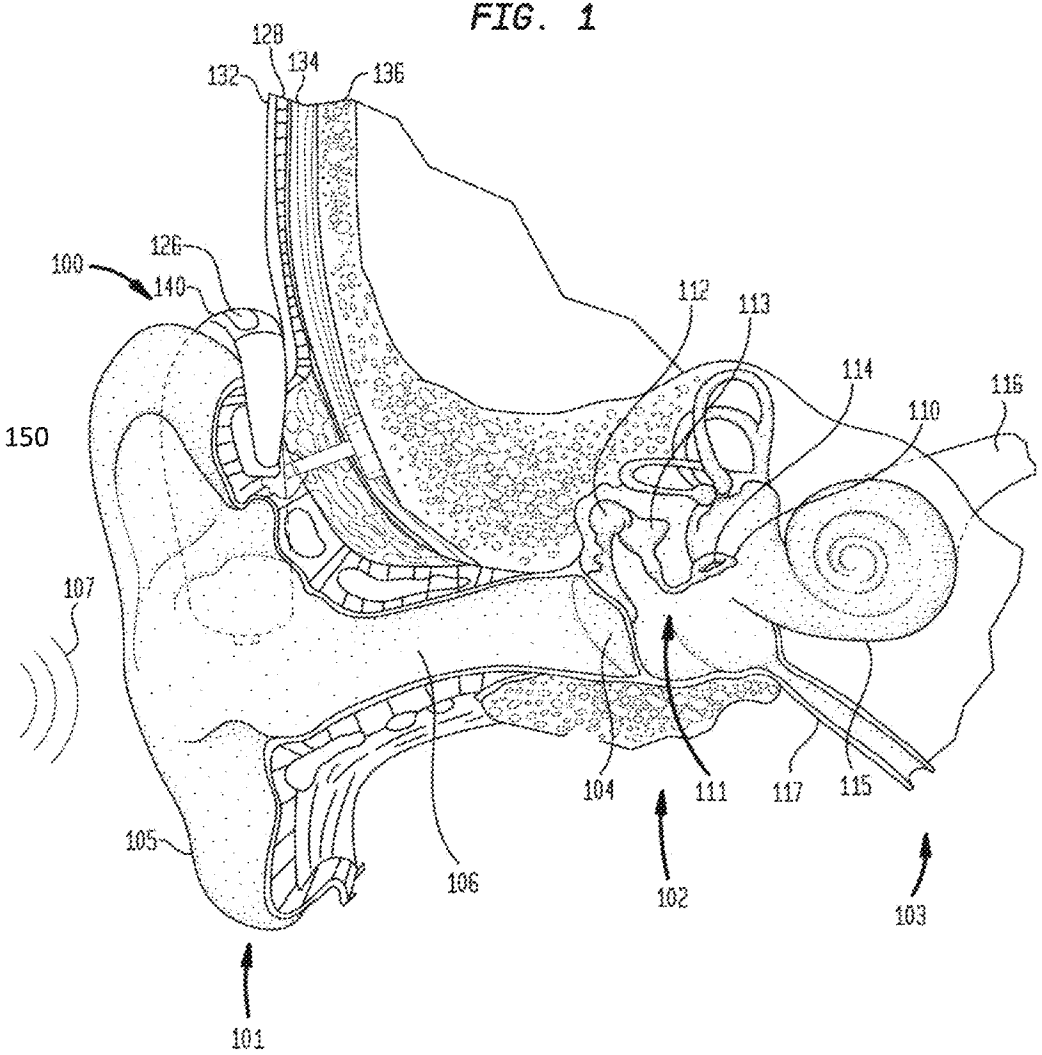
FIG. 1 is a perspective view of an exemplary bone conduction device in which embodiments of the present invention may be implemented.

FIG. 1 is a perspective view of a bone conduction device 100 in which embodiments of the present invention may be implemented, worn by a recipient. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of conduction device 100 relative to outer ear 101, middle ear 102 and inner ear 103 of a recipient of device 100. As shown, bone conduction device 100 is positioned behind outer ear 101 of the recipient. Bone conduction device 100 comprises an external component 140 in the form of a behind-the-ear (BTE) device, and an implantable component 150 in the form of a percutaneous vibration conductor, both of which are described in greater detail below. That said, in an alternative embodiment, component 150 is not an implantable component, but instead a component that remains on the outside of the skin of the recipient at all times. In this regard, in an exemplary embodiment, the BTE device is part of a passive transcutaneous bone conduction device instead of a percutaneous bone conduction device. Some exemplary embodiments according to the teachings detailed herein are described in additional detail below.

It is further noted that while the teachings detailed herein are described in terms of a BTE device, other types of external components can be utilized. By way of example only and not by way limitation, external component 140 can be a button sound processor. In at least some embodiments of a button sound processor, the button sound processor configured to be retained to the recipient without contacting the ear, or at least without utilizing the year to support the weight thereof. Still further, in at least some embodiments, a so-called soft band of the like can support an external component having an actuator or the like at a location on the recipient. In at least some embodiments, the teachings detailed herein with respect to the coupling can be utilized with any type of external device and/or any type of component coupled to the external device.

External component 140 typically comprises one or more sound input elements 126, such as a microphone, for detecting and capturing sound, a sound processing unit (not shown) and a power source (not shown). The external component 140 includes an actuator (not shown), which in the embodiment of FIG. 1, is located within the body of the BTE device, although in other embodiments, the actuator may be located remote from the BTE device (or other component of the external component 140 having a sound input element, a sound processing unit and/or a power source, etc.).

It is noted that sound input element 126 may comprise, for example, devices other than a microphone, such as, for example, a telecoil, etc. In an exemplary embodiment, sound input element 126 may be located remote from the BTE device and may take the form of a microphone or the like located on a cable or may take the form of a tube extending from the BTE device, etc. Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

The sound processing unit of the external component 140 processes the output of the sound input element 126, which is typically in the form of an electrical signal. The processing unit generates control signals that cause the actuator to vibrate. In other words, the actuator converts the electrical signals into mechanical vibrations for delivery to the recipient's skull.

In the embodiment of FIG. 1, implantable component 150, which in the present embodiment is a percutaneous vibration conductor 150, can be seen extending from a location abutting the BTE device, through the skin 132, fat 128 and muscle 134 to be in substantial abutting contact with the bone 136 (although in alternate embodiments, the percutaneous vibration conductor 150 does not abut bone 136, as will be detailed below). It is noted by the phrase "abutting contact," this distinguishes from a traditional bone fixture that extends into the bone of the recipient, at least before osseointegration occurs. That said, the term "substantial" qualifies this to include the use of a screw or other bone penetrating component detailed herein, which differ from traditional bone fixtures in that the bone penetrating components are not utilized to hold/carry the weight of an external component of a hearing prosthesis and/or a vibration generating component. Conversely, "complete abutting contact" means that there is no bone surface penetrating component (or bone penetrating component, at least not prior to osseointegration).

Accordingly, in at least some embodiments, the skin penetrating component when implanted in a recipient is not rigidly attached to bone of the recipient.

Briefly, and as will be expanded upon below, the combination of the external component 140 and the percutaneous vibration conductor 150 correspond to a device that comprises a prosthesis including an external component configured to output a signal in response to an external stimulus and a skin penetrating component configured to communicatively transfer the signal at least partially beneath the skin of the recipient. In this exemplary embodiment, the skin penetrating component (e.g., the percutaneous vibration conductor 150) is configured to extend into the skin of the recipient and substantially entirely lay above a surface of bone of a recipient in abutting contact thereto. In some embodiments, no part of the percutaneous vibration conductor 150 extends below a local surface of the bone. With respect to exemplary embodiments initially described, the signals are vibrations generated by the BTE device that are transferred to the percutaneous vibration conductor 150.

In the exemplary embodiment depicted in FIG. 1, vibrations generated by the BTE device 140 are conducted directly into the percutaneous vibration conductor 150 (e.g., because the percutaneous vibration conductor 150 directly abuts the BTE device, as can be seen), which in turn conducts those vibrations to bone 136. That is, vibrations generated by the actuator are transferred from the actuator of the BTE device, through the skin from the BTE device (directly from the actuator and/or through a housing of the BTE device), through the skin of the recipient, and into the bone of the recipient, thereby evoking a hearing percept. In an exemplary embodiment, the percutaneous vibration conductor does not bear any load (e.g., weight, torque) or at least any meaningful load, with respect to supporting the BTE device, at least with respect to supporting the BTE device against the pull of gravity and/or head movement, also as will be detailed below. Accordingly, in an exemplary embodiment, the percutaneous vibration conductor 150 is non-supportedly coupled to the BTE device 240.

Figure 2A:
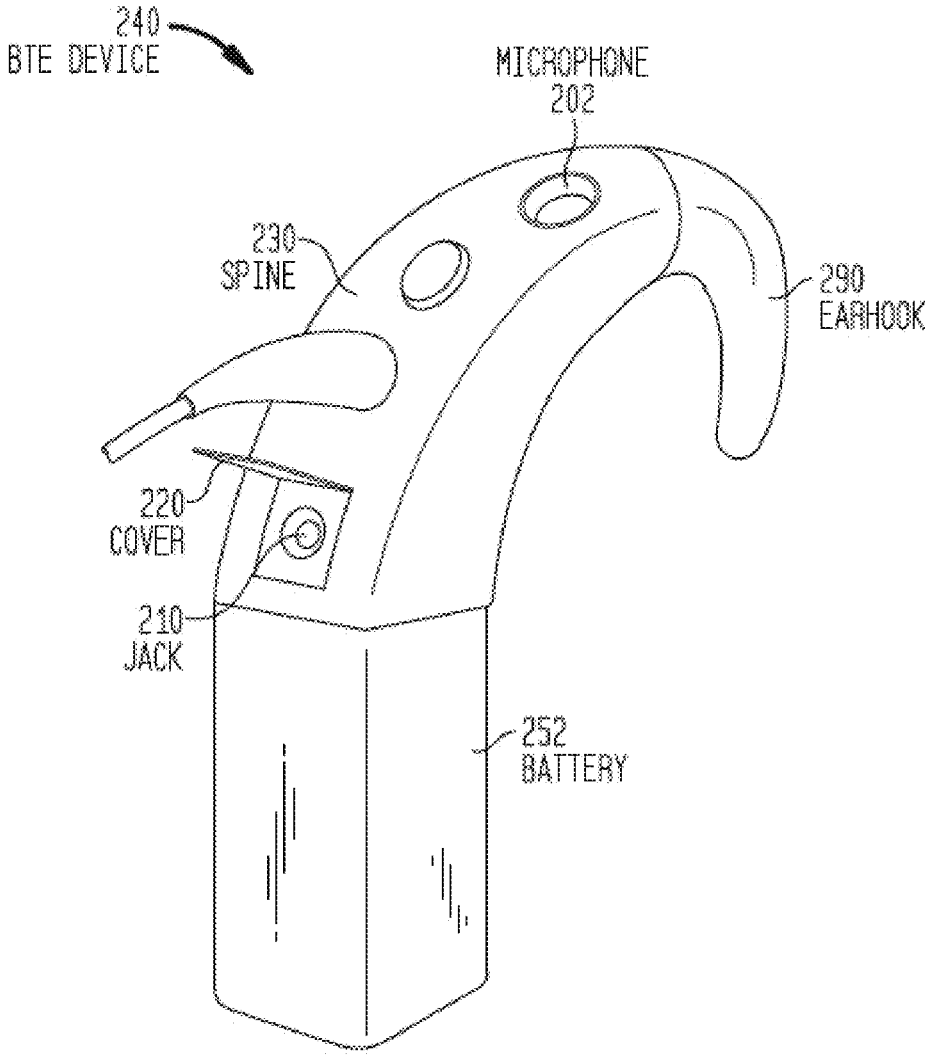
FIG. 2A is a perspective view of a Behind-The-Ear (BTE) device according to an exemplary embodiment.

Accordingly, in an exemplary embodiment, there is an operationally removable component (e.g., BTE device) that includes a vibrator that is in vibrational communication with the percutaneous vibration conductor 150 such that vibrations generated by the vibrator in response to a sound captured by sound capture device 126 are transmitted to the percutaneous vibration conductor 150 and from the conductor 150 to bone (either directly or through soft tissue as will be described in greater detail below) in a manner that at least effectively evokes a hearing percept. By "effectively evokes a hearing percept," it is meant that the vibrations are such that a typical human between 18 years old and 40 years old, having a fully functioning cochlea receiving such vibrations, where the vibrations communicate speech, would be able to understand the speech communicated by those vibrations in a manner sufficient to carry on a conversation provided that those humans are fluent in the language forming the basis of the speech. In an exemplary embodiment, the vibrational communication effectively evokes a hearing percept, if not a functionally utilitarian hearing percept. FIG. 2A is a perspective view of a BTE device 240 of a hearing prosthesis, which, in this exemplary embodiment, corresponds to the BTE device (external component 140) detailed above with respect to FIG. 1. BTE device 240 includes one or more microphones 202, and may further include an audio signal jack 210 under a cover 220 on the spine 230 of BTE device 240. It is noted that in some other embodiments, one or both of these components (microphone 202 and/or jack 210) may be located on other positions of the BTE device 240, such as, for example, the side of the spine 230 (as opposed to the back of the spine 230, as depicted in FIG. 2), the ear hook 290, etc. FIG. 2A further depicts battery 252 and ear hook 290 removably attached to spine 230.

It is noted that while some embodiments described herein will be described in terms of utilizing a BTE device as the external component, but again, as noted above, in alternate embodiments, other devices are utilized as the external component. For example, a button sound processor configured to vibrate according to the external component(s) detailed herein, a hair clip external component configured to vibrate according to the external component(s) detailed herein, a skin clip external component configured to vibrate according to the external component(s) detailed herein, a clothes clip external component configured to vibrate according to the external component(s) detailed herein, a pair of reading glasses (with real lenses or cosmetic (fake lenses)) configured to vibrate according to the external component(s) detailed herein, or other type of external bone conduction sound processor can be utilized as the external component. Any device or configuration that is usable with the conductors in general, and the couplings in particular, detailed herein, can be utilized in at least some embodiments provided that such an enable a bone conduction device to evoke a hearing percept.

Figure 2B:
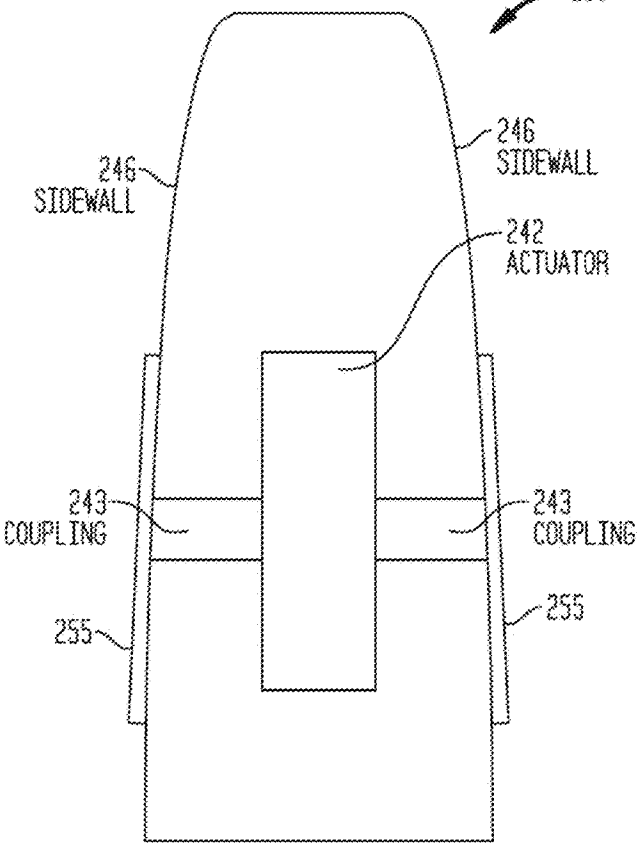
FIG. 2B is a cross-sectional view of a spine of the BTE device of FIG. 2A.

FIG. 2B is a cross-sectional view of the spine 230 of BTE device 240 of FIG. 2A. Actuator 242 is shown located within the spine 230 of BTE device 242. Actuator 242 is a vibrator actuator, and is coupled to the sidewalls 246 of the spine 230 via couplings 243 which are configured to transfer vibrations generated by actuator 242 to the sidewalls 246, from which those vibrations are transferred to the percutaneous vibration conductor 150 (or to skin of a recipient in embodiments where a transcutaneous bone conduction device BTE device is utilized, where the transcutaneous bone conduction device BTE device is utilized for percutaneous use by placing the BTE device in abutting contact with the percutaneous vibration conductor 150. In an exemplary embodiment, couplings 243 are rigid structures having utilitarian vibrational transfer characteristics. The sidewalls 246 form at least part of a housing of spine 230. In some embodiments, the housing seals the interior of the spine 230 from the external environment.

FIG. 2B also depicts a vibration transfer surface located on the sidewalls 246 of the BTE device 240. In at least some embodiments, vibration transfer surface 255 can be any surface that is configured to enable the teachings detailed herein and/or variations thereof to be practiced with respect to transferring vibrations from the BTE device 240 to the percutaneous vibration conductor 150, which can contact the BTE device 240 in the manner exemplarily depicted in FIG. 2C, where a shaft of the vibration transfer conductor 150 (i.e., the portion that extends outward away from the recipient towards the BTE device) is depicted abutting the vibration transfer surface 255 (which also means that the vibration transfer surface 255 is abutting the vibration transfer conductor 150). Additional details of some exemplary embodiments of some vibration transfer conductors 150 are described below.

In an exemplary embodiment, vibration transfer surface 255 can be the sidewall 246 of the spine 230. Alternatively, vibration transfer surface 255 can be a different component configured to enhance the transfer of vibrations from the spine 230 to the percutaneous vibration conductor 150. By way of example only and not by way of limitation, vibration transfer surface 255 can be part of a metal component, whereas the sidewall 246 can be a soft plastic or other soft material that is more comfortable for the recipient. Further, vibration transfer surface 255 can be a component that is configured to enhance maintenance of contact between the percutaneous vibration conductor 150 and the bone conduction device 240. By way of example only and not by way of limitation, in an exemplary embodiment, surface 255 can be an adhesive surface. For example, the surface 255 can be a chemical adhesive that adheres to the percutaneous vibration conductor 150. Alternatively, and/or in addition to this, surface 255 can be part of a permanent magnet and/or can be a ferromagnetic material, and at least a portion of the percutaneous vibration conductor 150 can be a ferromagnetic material and/or a permanent magnet as the case may be (discussed further below). Also, a permanent magnet and/or ferromagnetic material can be located in the housing of the BTE device such that the magnetic field of the permanent magnet located in the housing of the BTE device (or the permanent magnet that is a part of the percutaneous vibration conductor 150) extends through the housing so as to magnetically attract the percutaneous vibration conductor 150 to the BTE device and/or vice versa.

In a similar vein, a contacting surface of the percutaneous vibration conduction device 150 that contacts the BTE device 240 can also include a surface that is configured to enhance the maintenance of contact between the BTE device 240 and the percutaneous vibration conductor 150. For example, the contacting surface of the percutaneous vibration conductor 150 can include an adhesive thereon and/or the percutaneous vibration conductor 150 can include a ferromagnetic material (e.g. soft iron and/or a permanent magnet).

Also, in an exemplary embodiment, the contacting surfaces can have a texture that is conducive to enhancing the maintenance of contact between the BTE device and the percutaneous vibration conductor. For example, Velcro like structures can be located on the contacting surfaces. Still further by example, the contacting surfaces can have protrusions that create a slight interference fit between the two components (analogous to taking two hair combs or two hair brushes and pushing them towards each other such that the key/bristles interlock with each other).

Any device, system, and/or method that can enhance the maintenance of contact between the percutaneous vibratory conductor 150 and the BTE device 240 beyond that which results from the presence of the ear hook 290 and/or any grasping phenomenon resulting from the auricle 105 of the outer ear and the skin overlying the mastoid bone of the recipient (and/or any grasping phenomenon resulting from hair or magnetic attraction or skin aside from the outer ear or from clothing, etc., in devices other than a BTE device and/or glasses configured with an actuator, etc.).

That said, in an alternate embodiment, the BTE device 240 and/or the percutaneous vibration conductor 150 do not include components that enhance the maintenance of contact between those components beyond that which results from the presence of the ear hook 290 and/or any grasping phenomenon resulting from the auricle 105 of the outer ear and the skin overlying the mastoid bone of the recipient.

Accordingly, in an exemplary embodiment, the percutaneous vibration conductor 150 is non-rigidly coupled to the external component. In an exemplary embodiment of such an exemplary embodiment, this is owing to the use of adhesives that permit the orientation of the bone conduction device relative to the percutaneous vibration conductor to change while the percutaneous vibration conductor remains in contact with the BTE device. Still further, in an exemplary embodiment, the percutaneous vibration conductor 150 is magnetically coupled to the BTE device 240 such that the BTE device 240 is articulable relative to the percutaneous vibration conductor while the percutaneous vibration conductor 150 is magnetically coupled to the BTE device 240.

It is noted that the embodiment of FIG. 2B is depicted with vibration transfer surfaces 255 located on both sides of the BTE device. In this regard, an embodiment of a BTE device usable in at least some embodiments detailed herein and/or variations thereof includes a dual-side compatible BTE bone conduction device, as is depicted in FIGS. 2A and 2B.

In an exemplary embodiment of this embodiment, this enables the vibration transfer properties detailed herein and/or variations thereof resulting from the vibration transfer surface 255 to be achieved regardless of whether the recipient wears the BTE device on the right side (in accordance with that depicted in FIG. 1) or the left side (or wears two BTE devices). In a similar vein, the contact maintenance features can be located on both sides of the BTE device 240. That said, in alternate embodiments, the vibrational transfer surface 255 and/or the contact maintenance enhancement features are located only on one side of the BTE device 240. Still further, some embodiments can be practiced without the vibration transfer surfaces located on one or both sides (or anywhere on the BTE device) where the BTE device still functions as a dual-side compatible BTE bone conduction device.

In an exemplary embodiment, the vibrator actuator 242 is a device that converts electrical signals into vibration. In operation, sound input element 202 converts sound into electrical signals. Specifically, these signals are provided to vibrator actuator 242, or to a sound processor (not shown) that processes the electrical signals, and then provides those processed signals to vibrator actuator 242. The vibrator actuator 242 converts the electrical signals (processed or unprocessed) into vibrations. Because vibrator actuator 242 is mechanically coupled to sidewalls 246 (or to vibration transfer surface is 255), the vibrations are transferred from the vibrator actuator 142 to the percutaneous vibration conductor 150 (and then into the recipient bypassing at least the outer layer of skin of the recipient, as will be detailed further below).

It is noted that the BTE device 240 depicted in FIGS. 2A and 2B is but exemplary. Alternate embodiments can utilize alternate configurations of a BTE device.

It is further noted that in some embodiments, a BTE device is not used. Instead, an external device including the actuator and/or other components that can enable the teachings detailed herein and/or variations thereof to be practiced (e.g. the transfer of vibrations faced on captured sound generated by an actuator mounted externally on the recipient to the percutaneous vibration conductor 150) can be utilized. By way of example only and not by way of limitation, in an exemplary embodiment, a removable component of a bone conduction device (passive transcutaneous bone conduction device and/or percutaneous bone conduction device modified with a pressure plate, etc.) can be attached to a recipient via a soft band connection extending about a recipient's head such that contact between the external component and the percutaneous vibration conductor 150 is achieved. In an alternative embodiment, contact can be achieved or otherwise maintained via one or more or all of the devices disclosed in U.S. Patent Application Publication No. 2013/0089229. Any device, system, and/or method that can enable the teachings detailed herein and/or variations thereof with respect to achieving and/or maintaining contact between the removable component of the bone conduction device and the percutaneous vibration conductor 150 so that a bone conduction hearing percept can be achieved can be utilized in at least some embodiments.

Figure 3A:
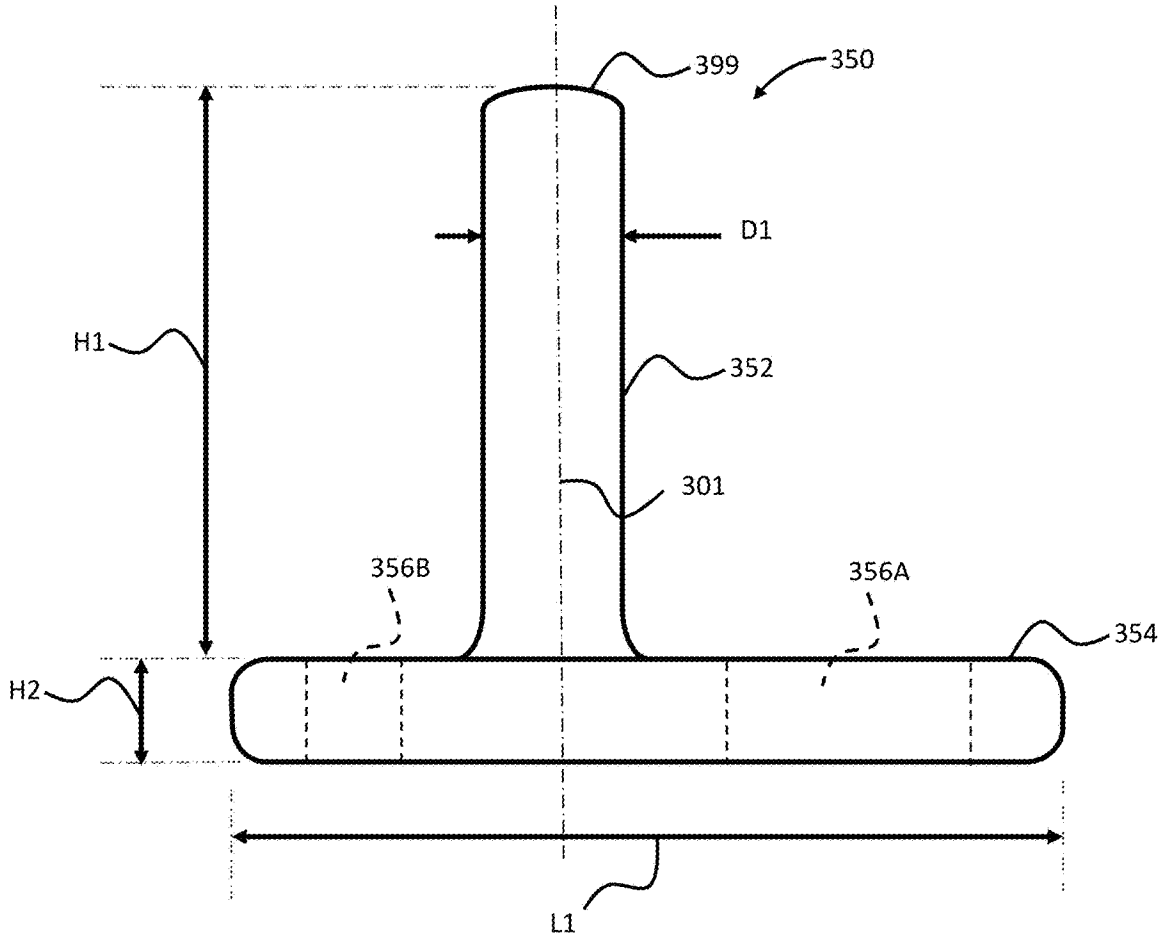
FIGS. 3A and 3B depict an exemplary percutaneous vibration conductor according to an exemplary embodiment.
Figure 3B:
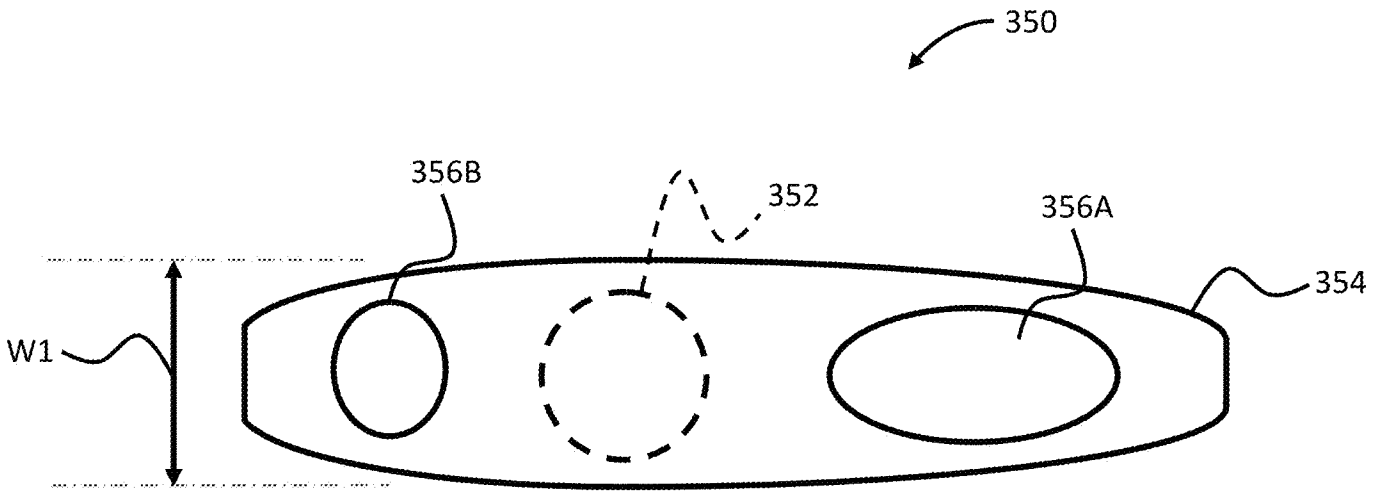

FIGS. 3A and 3B depict an exemplary percutaneous vibration conductor 350, which corresponds to percutaneous vibration conductor 150 detailed above. FIG. 3A is a side view of the exemplary percutaneous vibrational conductor 350, and FIG. 3B is a bottom view of the percutaneous vibration conductor 350. As can be seen, the percutaneous vibration conductor 350 includes a skin penetrating shaft 352 that extends in the longitudinal direction of the percutaneous vibration conductor 350 from a platform 354 that extends in the lateral direction away from the shaft 352 in two directions. Details of how the percutaneous vibration conductor 350 interfaces with the anatomy of the recipient are provided in greater detail below. The structure of the percutaneous vibration conductor 350 will first be described.

In an exemplary embodiment, the outer profile of the percutaneous vibration conductor 350 is that of an inverted "T" shape. In an alternate embodiment, the outer profile of the percutaneous vibration conductor 350 is that of an "L" shape. With respect to the embodiment specifically depicted in FIGS. 3A and 3B, the outer profile of the percutaneous vibration conductor 350 is between an "L" shape and an inverted "T" shape. In this regard, the portions of a platform 354 extend in opposite directions away from the shaft 352, with one portion extending a further distance from the shaft 35 to the other portion. That said, in an alternate embodiment, both portions of the platform 354 can extend a distance that is at about equal (including equal). Alternatively, embodiments can be such that the outer profile of the percutaneous vibration conductor 350 is that of an "L" shape, where there is only extension of the platform 354 in one direction. Accordingly, in an exemplary embodiment, the percutaneous vibration conductor 350 includes a laterally extending component (e.g., platform 354) configured to extend underneath the skin of the recipient and a longitudinally extending component (e.g., shaft 352) configured to extend through the skin of the recipient. In this exemplary embodiment, the laterally extending component extends a substantial distance in a direction at least approximately normal to the direction of extension of the longitudinally extending component.

Referring to FIG. 3A, as can be seen, the shaft 352 has a height H1 that is about 4 mm to about 14 mm. The shaft 352 has a maximum diameter D1 of 4 mm. The platform has a height H2 that is about 0.25 mm to about 1 mm and a length L1 of about 5 mm to about 10 mm. Referring to FIG. 3B, the platform has a maximum width W1 of about 2 mm to about 5 mm. In at least some embodiments, at least some of the aforementioned dimensions are based on the local skin thickness of the recipient. Thus, in an exemplary embodiment, there is a method that entails evaluating the thickness of the skin at the location where the hole through the skin will be created, and sizing the conductor accordingly (e.g., selecting a conductor having a height H1 based on the skin thickness).

In the exemplary embodiment of FIGS. 3A and 3B, the shaft 352 is of sufficient length such that when the platform is located against bone and/or in relatively close proximity to bone, the shaft extends through the soft tissue of the recipient (muscle, fat and skin) to a location substantially flush and/or proud of the surface of the skin at the location where the shaft 352 emerges from the recipient. This can be such that the contact surface 399 at the end of the shaft 352 can abut the BTE device such that vibrations generated by the BTE device can be directly conducted directly from the BTE device to the percutaneous vibration conductor 350 to thereby evoke a bone conduction hearing percept. In this regard, surface 399 is any surface that can enable such conduction to take place. In the embodiment of FIG. 3A, the surface is depicted as being curved in shape (concave relative to the platform 354/convex relative to the BTE device). In an alternate embodiment, as detailed below, contact surface 399 can be flat. In an alternative embodiment, contact surface 399 can be convex in shape relative to the platform 354. Furthermore, contact surface 399 can be a surface that is not uniform and/or not smooth. In this regard, contact surface 399 can comprise a plurality of protrusions extending away from the platform 354. These protrusions can correspond to, for example, bumps at the end of the shaft 352. Contact surface 399 can include any of the features detailed herein with regard to maintaining and/or enhancing contact between the BTE device and the contact surface 399. Furthermore, contact surface 399 need not be symmetric about the longitudinal axis of the shaft 352. For example, the contact surface can have a grade (e.g., a slope) relative to the direction normal to the longitudinal axis of the shaft 352. In an exemplary embodiment, this grade can enable increased overall contact with the BTE device (i.e., the average distance between the respective contact surfaces on a per unit basis is lower relative to that which would be the case in the absence of such a surface, where a distance of 0 mm corresponds to contact between the respective surfaces) in scenarios where the shaft 352 extends towards the BTE device at an oblique angle. For example, if the shaft 352 extends towards the vibration transfer surface 255 at a direction of 15° from normal, surface 399 can be, for example, a flat surface that is angled at 15° relative to the direction normal to the longitudinal axis of the shaft 352, thus at least presenting in theory complete contact between the contact surface 399 and the vibration transfer surface 255 of the BTE device. Indeed, in some alternate embodiments, the end of the shaft 352 can be gimbaled (mechanically or flexibly, or by any other means that can enable increased contact relative to that which would be the case in scenarios where the shaft extends at an oblique angle from the surface of the BTE device) so that the contact surface 399 aligns to that of the interfacing portion of the BTE device. Note further that in some embodiments, the BTE device can include a receptacle to receive at least a portion of the shaft 352. The receptacle can be dimensioned to receive a substantial portion of the shaft (e.g., about 10%, about 15%, about 20%, etc., of the length of the shaft) and/or can be dimensioned to receive a relatively limited portion of the shaft (e.g. receptacle can be a divot that receives a portion of the surface 399 or all of the surface 399). In some embodiments, the receptacle results in a slip fit between the two components such that the components are rigidly coupled to one another with respect to the application of a moment applied on a plane normal to the longitudinal axis of the shaft 352 (analogous to a dowel pin extending from a bearing). In some embodiments, the receptacle results in a fit such that the receptacle aligns the shaft 352 with the BTE device (analogous to a drinking glass with a straw therein.) In some embodiments, the shaft of the percutaneous vibration conductor is configured with a depth gauge or stopper on the shaft that prevents over insertion into the BTE device.

Any device, system, and/or method that can enable the end of the shaft 352 to contact the BTE device to enable bone conduction hearing percept to take place can be utilized in at least some embodiments.

In an exemplary embodiment, the bottom (i.e., the side facing the bone of the recipient when inserted/implanted therein) of the platform 354 is configured to surface mount on bone of the recipient, as can be seen in FIG. 1. However, in at least some embodiments, as will be detailed below, embodiments can be practiced where the platform 354 does not come into contact with the bone (this can be done even for embodiments where the platform 354 is configured to surface mount on bone). Further, in at least some embodiments, also as will be detailed below, while the platform 354 is configured to surface mount on bone, without any portion thereof extending below a local surface of the bone, embodiments can be practiced where the platform 354 becomes at least partially encapsulated by bone via bone growth around at least some portions of the platform 354. This is as contrasted to a traditional implant of a percutaneous bone conduction device, which has a substantial portion of the skin penetrating component (combined abutment and bone fixture) that extends below a local surface of the bone (e.g., a portion of the bone fixture extends into the bone).

Accordingly, in an exemplary embodiment, where X is the height of the percutaneous vibration conductor (i.e., the distance from the bottommost portion (the portion that is closest to the surface of the bone with respect to conductors that do not penetrate the surface of the bone or the portion that extends deepest into the bone after implantation with respect to conductors that penetrate the surface of the bone) to the top-most portion of the conductor (the portion that abuts the contact surface of the BTE device or the portion that protrudes the furthest into the BTE device) (H1+H2 with respect to the embodiment of FIG. 3A) and Y is the furthest distance of penetration below the surface of the bone after implantation (zero in the embodiment of FIG. 3A), X/Y equals about a value within the range of 0.0 to about 0.3 or any value or range of values therebetween in about 0.01 increments. (e.g., 0.0, 0.01, 0.1, about 0.03 to about 0.24, etc.).

In at least some embodiments, the platform 354 is configured to resist relative movement of the percutaneous vibration conductor 150 in a direction below the surface of the bone (i.e., movement in the longitudinal direction into the bone/a direction normal to the tangent plane of the local surface of the bone). More particularly, because the shaft 352 extends from within the recipient away from the bone of the recipient to a location outside the recipient such that the removable component of the bone conduction device (e.g., BTE device, etc.) abuts the end of the shaft 352, in the absence of the platform 354, a force applied to the removable component of the bone conduction device and/or to the shaft 352 can result in that force being transferred to the bone of the recipient. Accordingly, an exemplary embodiment includes a platform 354 that has a bottom surface having an area that distributes the force such that the resulting pressure (force divided by area) is below that which would be expected to cause at least serious damage to the bone of the recipient with respect to expected forces applied to the percutaneous vibration conductor 350 in the longitudinal direction towards the bone.

In the embodiment of FIGS. 3A and 3B, the profile of the platform 354 is configured to provide sufficient resistance to relative movement (i.e., movement relative to the recipient) in the longitudinal direction towards the bone to achieve the just-noted features (i.e., movement towards the recipient). In the embodiment of these figures, the profile of the platform 354 is also configured to provide sufficient resistance to localized pressure in the longitudinal direction towards the bone to avoid and/or substantially reduce the possibility that localized pressure will increase to a level deleterious to the bone/skull.

With respect to these figures, it can be seen that the shaft 352 has a circular cross-section lying on the plane normal to the longitudinal direction of the shaft 352 (e.g., lying on a plane normal to a direction of skin penetration). In an exemplary embodiment, an outer diameter of the shaft 352 lying on that plane is less than about half of the maximum diameter of the platform 345 also lying on a plane normal to the direction of the shaft 352. In the embodiments of FIGS. 3A and 3B, this is achieved because the length of the platform 354 (i.e., the dimension of the horizontal direction in FIG. 3B) is over twice that of an outer diameter of the shaft. Alternatively and/or in addition to this, this can be achieved because the width of the platform 354 (i.e., the dimension of the vertical direction in FIG. 3B) is over twice that of an outer diameter of the shaft 352. That said, in alternate embodiments, these relations may be different. Any configuration of the platform that can enable the just-described resistance can be utilized in at least some embodiments. Still further, while the aforementioned dimensions have been described in terms of the longitudinal axis of the shaft 352 being coaxial with the direction of skin penetration, in alternate embodiments, the longitudinal axis of the shaft 352 may not be coaxial with the direction of skin penetration.

In the embodiment of FIGS. 3A and 3B, the profile of the shaft 352 and the platform 354 can enable insertion of the percutaneous vibration conductor 350 through the puncture in the skin of the recipient above the mastoid bone so that the percutaneous vibration conductor 350 can be positioned approximately in the manner detailed above in FIG. 1 and/or according to other utilitarian positioning's as detailed herein and/or variations thereof that can enable the teachings detailed herein to be practiced. Additional features of this concept are described below with respect to methods of insertion of the percutaneous vibration conductor 350. Briefly, however, as can be seen in the figures, the profiles of the percutaneous vibration conductor 350 are generally streamlined to enable relatively smooth insertion of the percutaneous vibration conductor 350 into a puncture in the skin that extends from the skin surface to the mastoid bone and/or close to the mastoid bone (at least a distance through the skin such that the platform 354 can be inserted under the periosteum). In this regard, the platform 354 is in the form of a truncated oblong ellipse. While the front end and the rear end of the platform 354 do include a blunt portion, the curvatures of the portions of the platform 354 extending away from those blunt portions are such that the blunt portions generally do not interfere with insertion into the puncture. Indeed, in at least some embodiments, the blunt portions can reduce the likelihood that the platform 354 can be deleteriously caught onto the skin during the insertion process, at least in embodiments where such a scenario is not seen as utilitarian or otherwise desirable.

That said, in an alternate embodiment, one or both of the ends of the platform 354 can be configured such that instead of blunt ends, more streamlined ends are present (e.g., completely curved ends). Conversely, in at least some embodiments, one or both of the ends can be relatively sharp so as to allow for insertion of the percutaneous vibration conductor into the recipient without a previously created puncture into the skin.

In at least some embodiments, the platform is in the form of a beam extending away from a longitudinal axis of the percutaneous vibration conductor (e.g., the axis of the shaft 352). Any configuration of the platform 354 that can enable the percutaneous vibration conductor 350 to be inserted into a recipient according to the teachings detailed herein and/or variations thereof can be utilized providing that such can enable the teachings detailed herein and/or variations thereof.

In an exemplary embodiment, the platform 354 is configured to enhance osseointegration of at least the platform 354 to bone 136 of the recipient, or at least enable tissue of the recipient, whether it be bone or soft tissue (e.g., skin, fat and/or muscle, etc.) to grow into the platform 354 to aid in securing the percutaneous vibration conductor 150 to the recipient. In this regard, platform 354 includes through holes 356A and 356B that extend completely through the platform 354 from a bottom (i.e., the side facing bone when implanted in the recipient) to the top (i.e., the side facing the BTE device/the side facing the surface of the skin when implanted in the recipient) of the platform. In an alternate embodiment, there are no through holes through the platform 354. Still further, in an alternate embodiment, there is only one through hole in the platform 354, while in alternate embodiments there are three or more holes through the platform. As can be seen from FIG. 3B, in an exemplary embodiment, the through holes 356A and 356B are elliptical in shape. In alternative embodiments, one or more or all of the through holes can be circular, rectangular (square or otherwise), etc. Any size, shape or configuration of holes can be utilized to enhance osseointegration and/or to promote or otherwise enable tissue growth to grow into the platform, providing that the teachings detailed herein and/or variations thereof can be practiced.

Still further, in an exemplary embodiment, at least some of the surfaces of the platform 354 can be coated with a substance that enhances osseointegration. By way of example only and not by way of limitation, the bottom surface and/or the side surfaces of the platform 354 can be coated with hydroxyapatite. Alternatively and/or in addition to this, one or more of the surfaces can be roughened and/or patterned with a texture that promotes osseointegration.

It is noted that there can be utilitarian value with respect to managing the coupling between the vibration transfer surface 255 of the BTE device 240 and the contact surface 399 of the percutaneous vibration conductor 150. More specifically, by way of example only and not by way of limitation, in at least some embodiments, the BTE device 240 and the vibration conductor 150 are configured such that one can move relative to the other. By way of example only and not by way of limitation, the contacting surfaces are configured to slide relative to one another and/or are coupled to one another in a torque-free manner. Some examples of such exemplary embodiments will now be described.

Figure 2C:
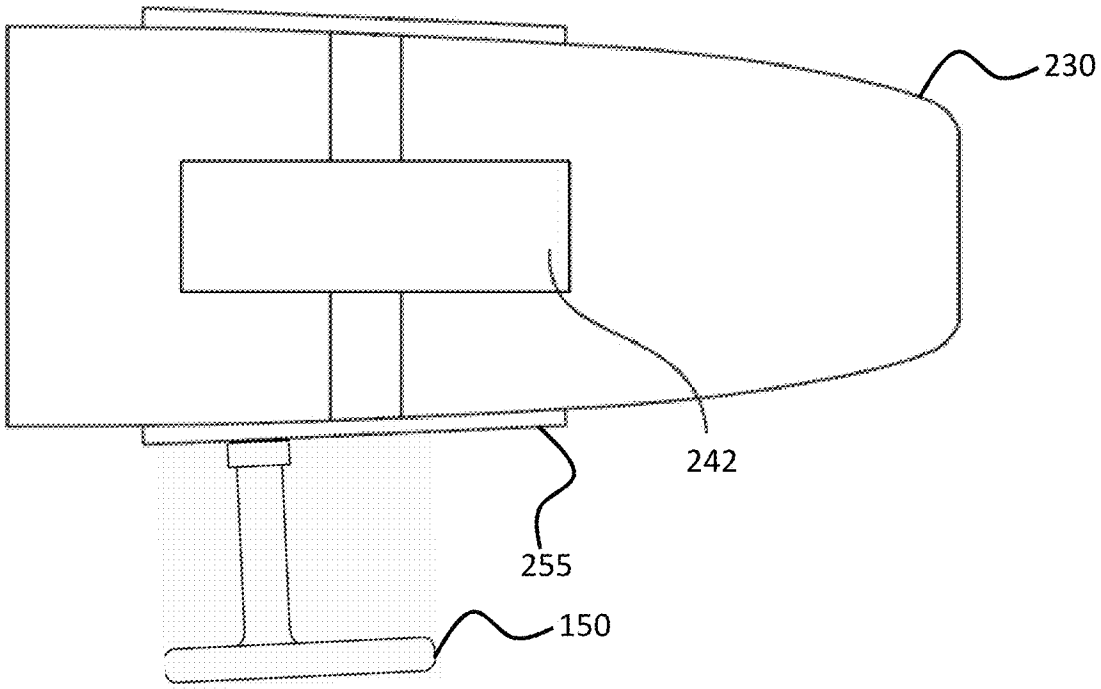
FIG. 2C depicts the portion of the BTE device depicted in FIG. 2B in contact with an exemplary percutaneous vibration conductor 150.
Figure 4A:
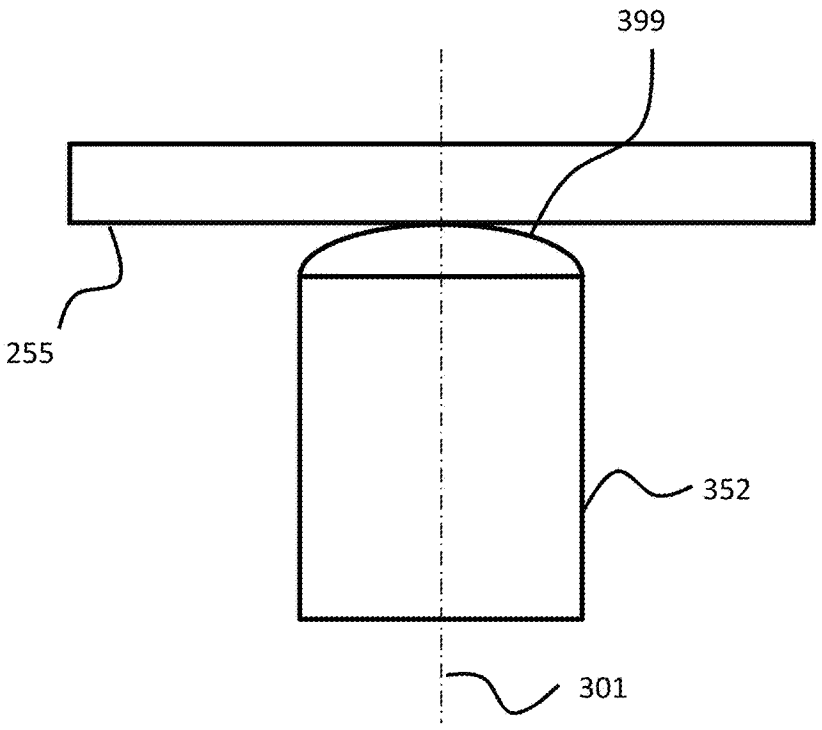
FIG. 4A depicts an exemplary interface between a BTE device component and a vibration conductor according to an exemplary embodiment.
Figure 4B:
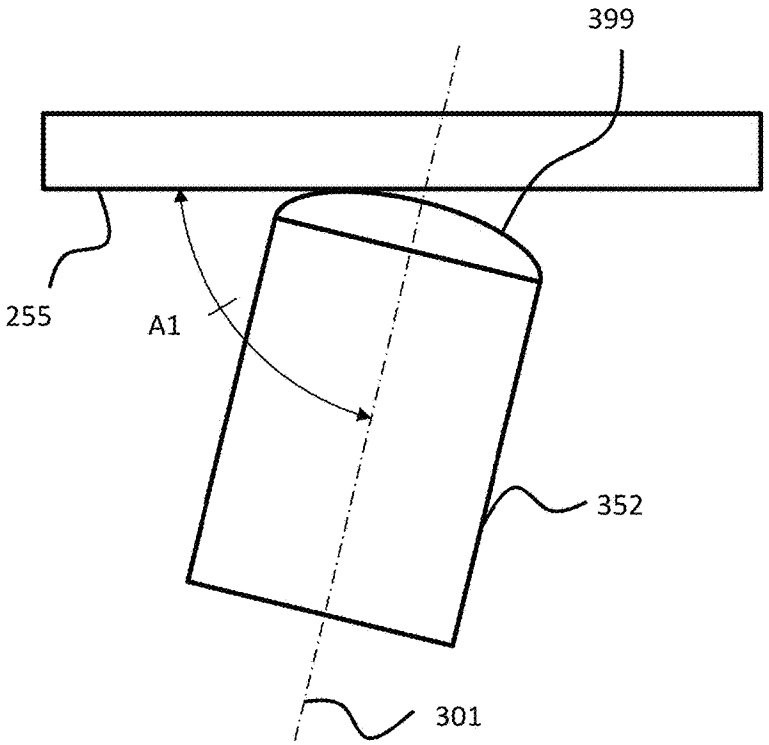
FIG. 4B depicts an exemplary movement between BTE device component and a vibration conductor of FIG. 4A according to an exemplary embodiment.

As can be seen in FIG. 3A, contact surface 399 is curved. As can be seen in FIGS. 2B and 2C, vibration transfer surface 255 is flat. Functionally, the interface between the two surfaces can be represented as seen in FIGS. 4A and 4B, which depict a functional view looking in the same direction as that of FIG. 2C (equivalent of a close-up view thereof). FIG. 4A depicts an orientation of the shaft 352 of the percutaneous vibration conductor 150 such that the longitudinal axis 301 of the shaft 352 is substantially (which includes exactly) normal to the vibrational transfer surface 255 of the BTE device 240. FIG. 4B depicts an orientation of the shaft 352 of the percutaneous vibration conductor 150 such that the longitudinal axis 301 of the shaft 352 is angled (which, as used herein, means not normal to a reference surface, such as a tangent surface) to the vibrational transfer surface 255 of the BTE device 240. In an exemplary embodiment, the surface 399 can be configured such that the shaft 352 can rotate/rock relative to surface 255 such that the relative angle A1 between the longitudinal axis 301 and the surface 255 can be about 75 degrees as shown. In an exemplary embodiment, the surfaces are configured such that rotation is enabled (while still enabling a hearing percept to be effectively evoked via the coupling—it is noted that unless otherwise indicated, all coupling scenarios enable a hearing percept to be effectively evoked) relative angle A1 can be about 20, 25, 30, 35, 40, 45, 50, 55, 60, 65, 70, 75, 80 or 85 or 90 degrees or any value or range of values therebetween in about 1 degree increments (about 47 degrees, about 59 degrees, about 51 degrees to about 81 degrees, etc.). It is noted that the configurations of the surfaces can be such that other angles A1 can be enabled. Any angle A1 that can be practiced while enabling the teachings detailed herein can be utilized in at least some embodiments.

Figure 4C:
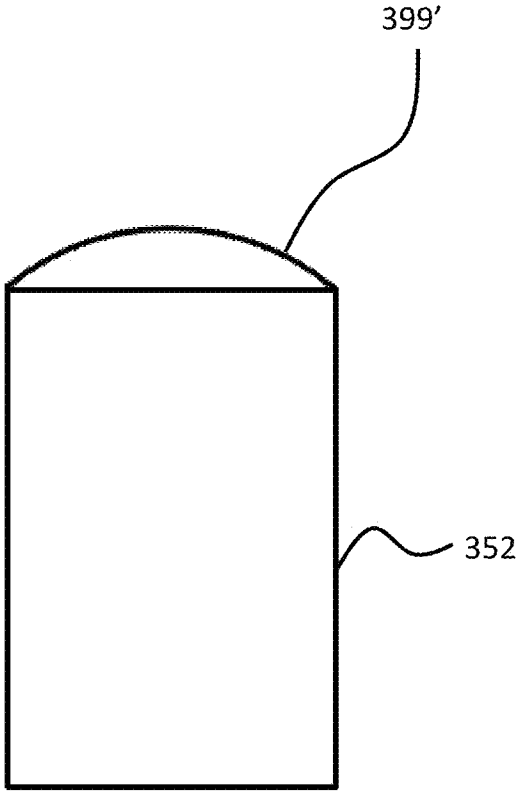
FIGS. 4C-4E depict an exemplary contact surface of an exemplary embodiment of a vibration conductor according to an exemplary embodiment.
Figure 4D:
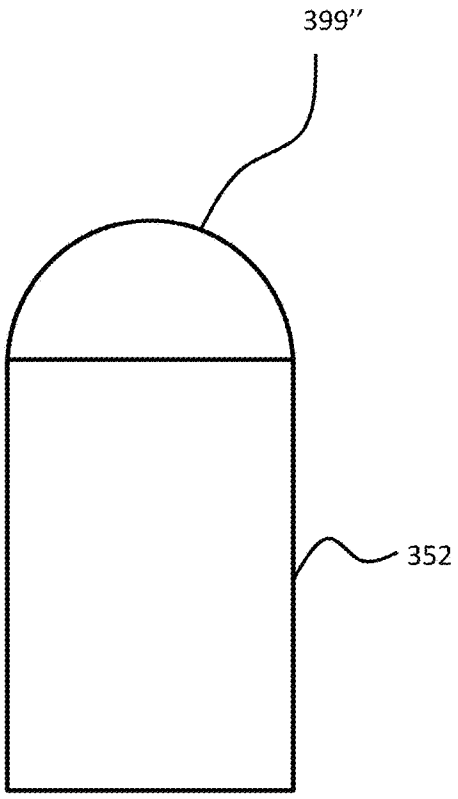
Figure 4E:
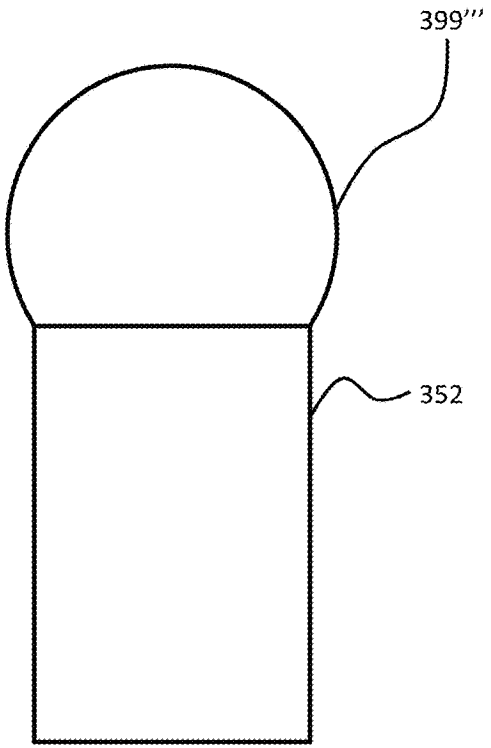

It is noted that FIG. 4B and the associated features detailed above not only represents in the range of relative movement of the shaft 352 with respect to the surface 255 when looking in the direction of FIG. 2B (a first degree of freedom—rocking movement in the plane of that view), but also when looking in the direction that is angled to the view of FIG. 2C (e.g., in a plane that is normal from that view, such as from the top looking down, from the bottom, looking up), and thus a second degree of freedom—rocking movement in the plane normal to the view of FIG. 2C). Accordingly, in an exemplary embodiment, the surface 399 is a surface that is curved in multiple planes. In an exemplary embodiment, surface 399 is elliptical, as seen in FIG. 4A. In an alternate embodiment, the contact surface is spherical, as represented by surface 399' in FIG. 4C (surface 399' being a portion of a hemisphere). In an exemplary embodiment, the contact surface forms at least a hemisphere, as represented by surface 399" in FIG. 4D. In alternative embodiment, the contact surface forms a portion of a sphere, as represented by surface 399'" in FIG. 4E. The contact surface can also be a sphere in some alternate embodiments.

Figure 4F:
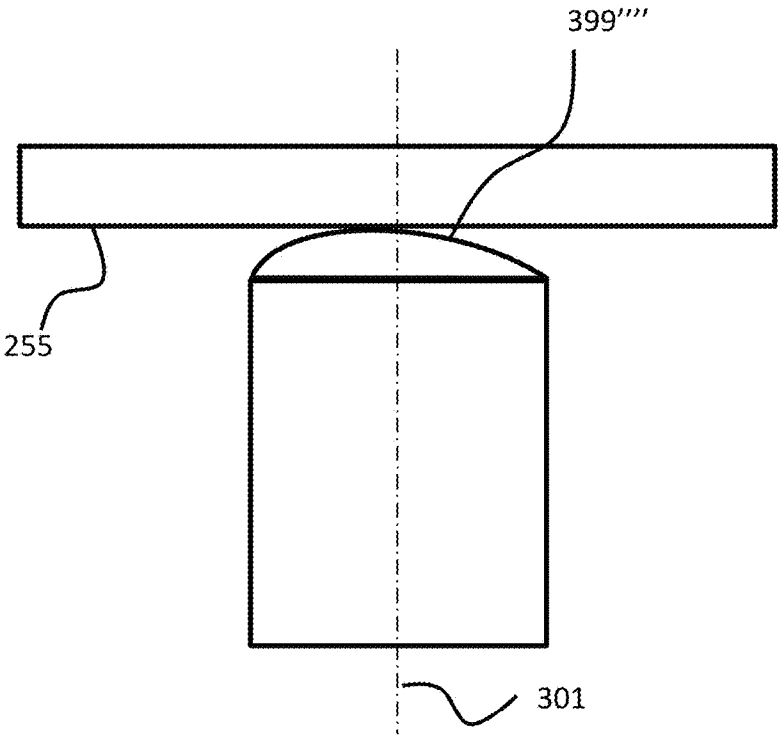
FIG. 4F depicts another exemplary contact surface of an exemplary embodiment of a vibration conductor according to an exemplary embodiment contacting a vibration transfer surface of a BTE device.

In an exemplary embodiment, the contact surface is rotationally symmetrical about axis 301. That said, in an alternative embodiment, the contact surface need not be rotationally symmetrical about axis 301, as can be seen in FIG. 4F, which presents an alternate surface 399"". In some exemplary embodiments, the contact surface is a complex surface. Any contact surface that can enable the teachings detailed herein to be practiced can be utilized in at least some embodiments.

Figure 4G:
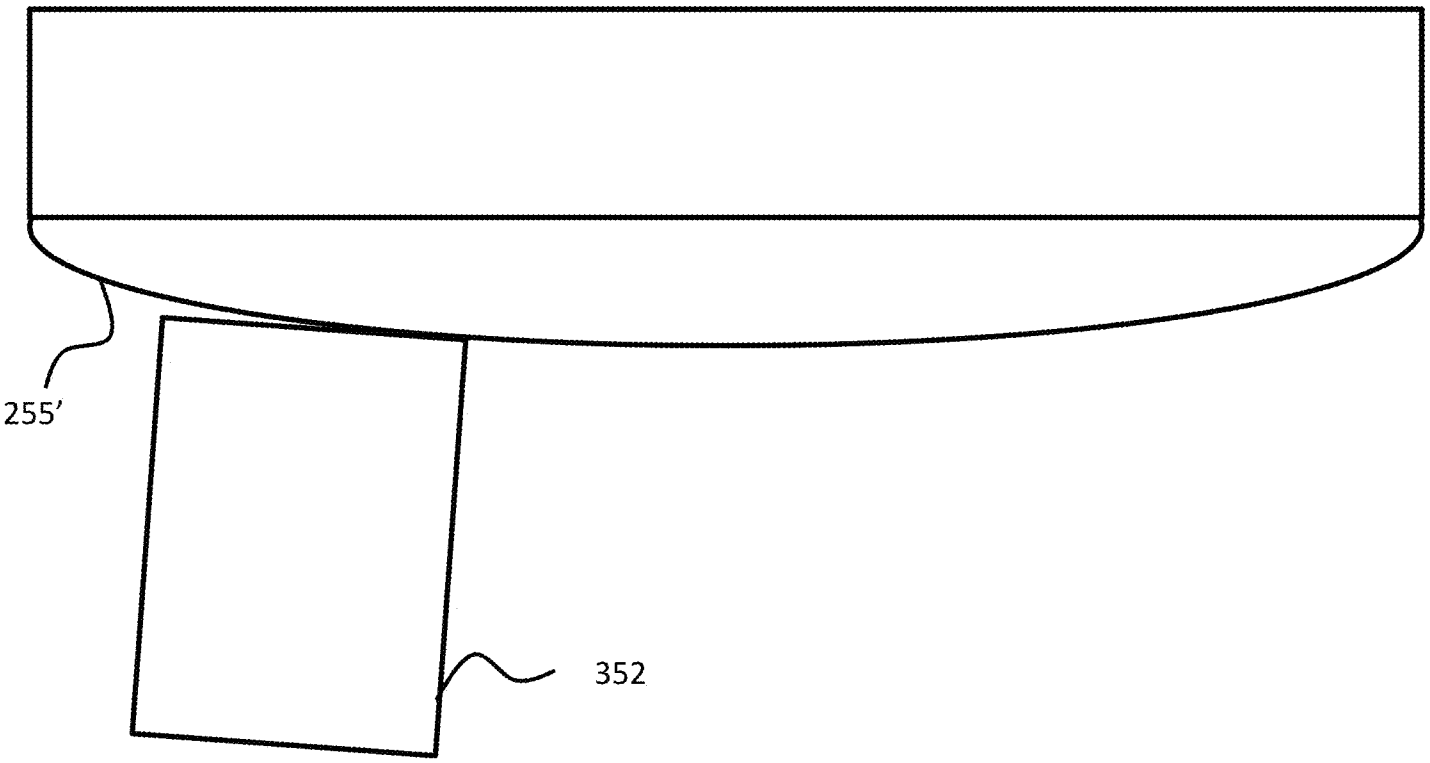
FIG. 4G depicts another exemplary contact surface of an exemplary embodiment of a vibration conductor and an exemplary vibration transfer surface of a BTE device according to an exemplary embodiment.
Figure 4H:
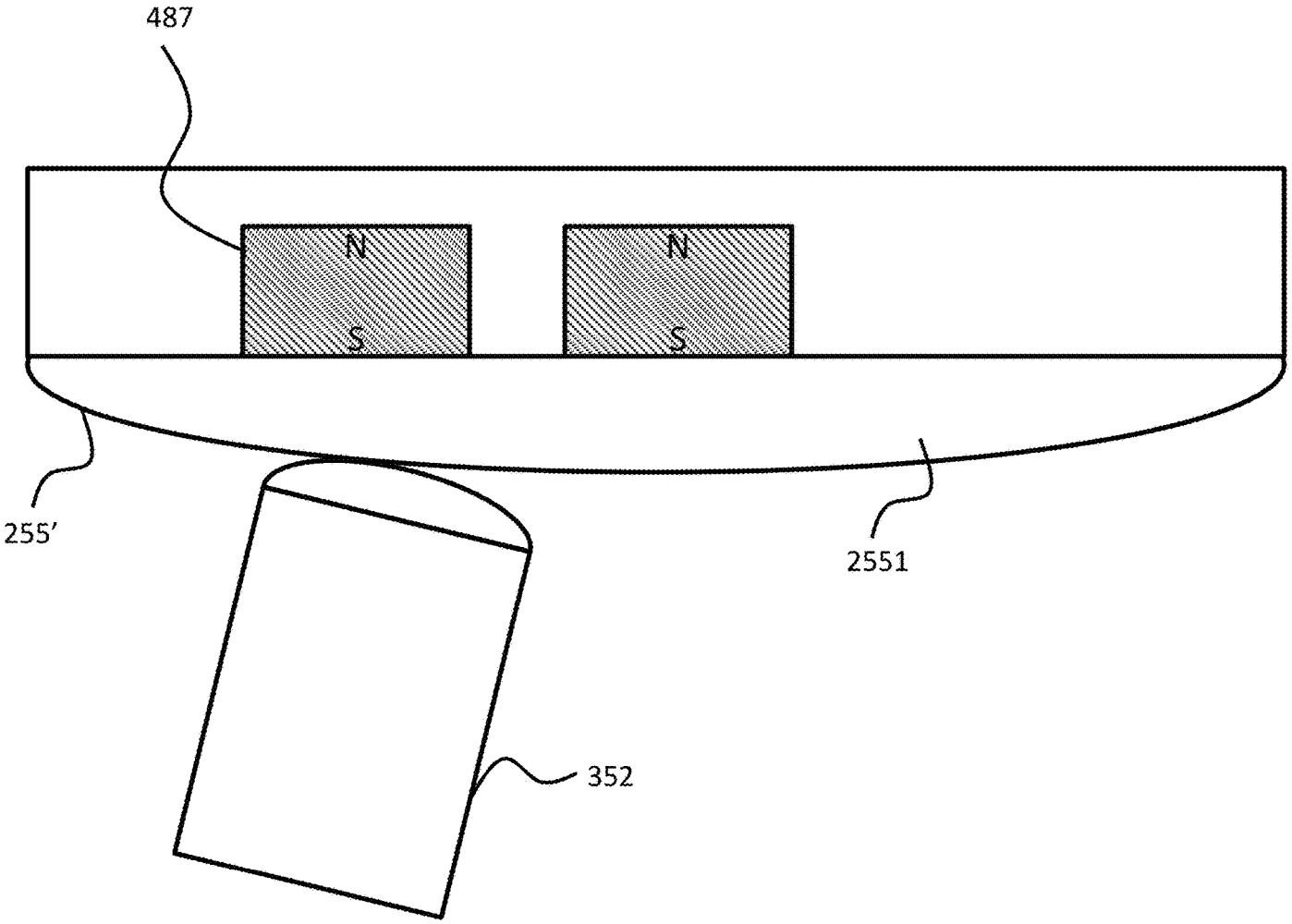
FIG. 4H depicts another exemplary contact surface of an exemplary embodiment of a vibration conductor and an exemplary vibration transfer surface of a BTE device according to an exemplary embodiment.

It is noted that while the embodiment of FIG. 4A is presented in terms of vibrational transfer surface 255 being flat, the vibrational transfer surface can also or alternatively be curved. In an exemplary embodiment, this surface can be convex relative to the vibration conductor 150, can be concave relative to the percutaneous vibration conductor 150, and can have portions that are convex and other portions that are concave relative to the percutaneous vibration conductor 150. Also, it is noted that some portions of the vibrational transfer surface 255 can be flat as well as concave and or convex. These alternate surfaces can be practiced with the surfaces detailed above with respect to the contact surface of the percutaneous vibration conductor 150 detailed above. Also, it is noted that these alternate surfaces can be practiced with a contact surface that is flat. FIG. 4G functionally presents such an exemplary embodiment, where vibration transfer surface 255' is a curved surface and the contact surface of the shaft 352 of the percutaneous vibration conductor 150 is flat. FIG. 4H functionally presents another such exemplary embodiment, where vibration transfer surface 255' is a curved surface and the contact surface of the shaft 352 of the percutaneous vibration conductor 150 is also curved (corresponding to surface 399 of FIG. 4A).

In an exemplary embodiment, the coupling of the contact surface to the vibration transfer surface is achieved via magnetic attraction, such as by magnets 487 as depicted in FIG. 4H. Some exemplary features of this will now be described.

Hereinafter, embodiments will be described in terms of contact surface 399 and vibration transfer surface 255. However, it is noted that unless otherwise specified, reference to these surfaces corresponds to a reference to the other surfaces detailed herein and/or variations thereof.

An exemplary embodiment is such that at least a portion of the shaft 352 is made of a permanent magnetic material. In an exemplary embodiment, the surface 399 is made of a permanent magnetic material. That said, in an alternative embodiment, surface 399 is a material that covers a permanent magnetic material (e.g., permanent magnet is clad in another material, a shim is located over the permanent magnetic material, etc.). In an alternate embodiment, the permanent magnet is located further away from the surface 399. If the permanent magnet is located in the vibration conductor, in at least some embodiments, at least a portion of the BTE device 240 is made of a ferromagnetic material (e.g., iron) that is not a permanent magnet, although in other embodiments, the BTE device can also include a permanent magnet. In an exemplary embodiment, vibration transfer surface 255 is made of a ferromagnetic material. That said, in an alternate embodiment, surface 255 is a material that covers a ferromagnetic material (e.g., a ferromagnetic material is clad in a material that forms the vibration transfer surface 255, or is established by a shim, such as is the case with the embodiment of FIG. 4H, as will be described below). Alternatively, the BTE device 240 contains a permanent magnet. In an exemplary embodiment, vibration transfer surface 255 is a permanent magnet, while in an alternate embodiment, vibration transfer surface 255 is a surface that covers a permanent magnet. Conversely, the shaft 352 of the percutaneous vibration conductor 150 is made of a ferromagnetic material that is not a permanent magnet. In an exemplary embodiment, the surface 399 is formed by a ferromagnetic material. Alternatively, the surface 399 covers a ferromagnetic material. All this said, again, in an exemplary embodiment, a permanent magnet can be located in the BTE device 240 and a permanent magnet can be located in the shaft 352.

Figure 4I:
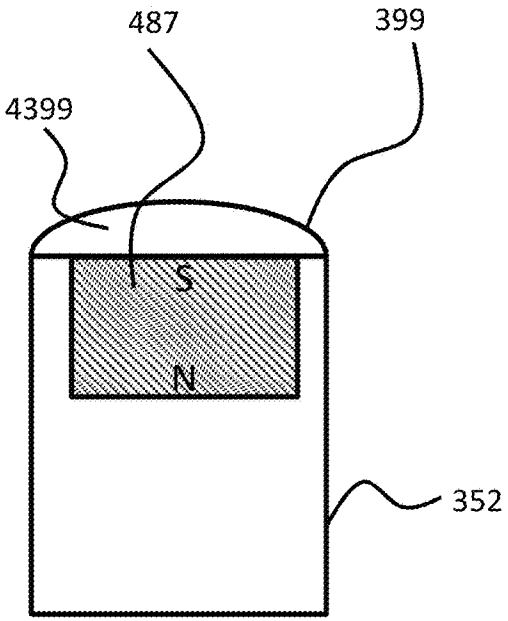
FIG. 4I depicts an exemplary embodiment of a vibration conductor having a permanent magnet therein.

It is noted that while some embodiments can be practiced such that the curved surfaces are formed by ferromagnetic material and/or permanent magnets (i.e., the ferromagnetic material and/or the permanent magnet as curvature according to the curves detailed herein), in an exemplary embodiment, a non-magnetic component, such as a shim, can be placed over the ferromagnetic material and/or magnet(s). This material (e.g., shim) can have a flat surface (at the coupling location) or can have a curved surface (at the coupling location), depending on how it is used. FIG. 4H depicts such an exemplary configuration, where a shim 2551 overlies permanent magnets 487 (alternatively, elements 487 could be ferromagnetic material other than a permanent magnet). As can be seen, the permanent magnets 487 are configured in a generally linear manner, and the shim 2551, which has the curved surface 255', overlies the permanent magnets 487. Thus, the functionality of the teachings detailed herein can be achieved without shaping the magnets or ferromagnetic material (or assembly of magnets, as will be detailed below) to have the curved surface(s). It is noted that this configuration can be used alternatively and/or in additionally on the vibration conductor 350. FIG. 4I presents such an exemplary configuration, where shaft 352 contains permanent magnet 487, and shim 4399 which establishes surface 399 overlies that permanent magnet.

Some exemplary embodiments will now be detailed with respect to a configuration where the permanent magnets are located in the BTE device 240, and form at least a portion of the vibration transfer surface 255. The shaft of the vibration conductor 350 is made out of ferromagnetic material, such as soft iron, or other soft magnetic material. Alternatively and/or in addition to this, the shaft can contain a ferromagnetic material (e.g., element 487 in FIG. 4I is not a permanent magnet, but, for example, soft iron). It is further noted that the teachings detailed herein with respect to the permanent magnets in the BTE device can also be utilized for embodiments where the permanent magnets are located in the vibration conductor.

Figure 5A:
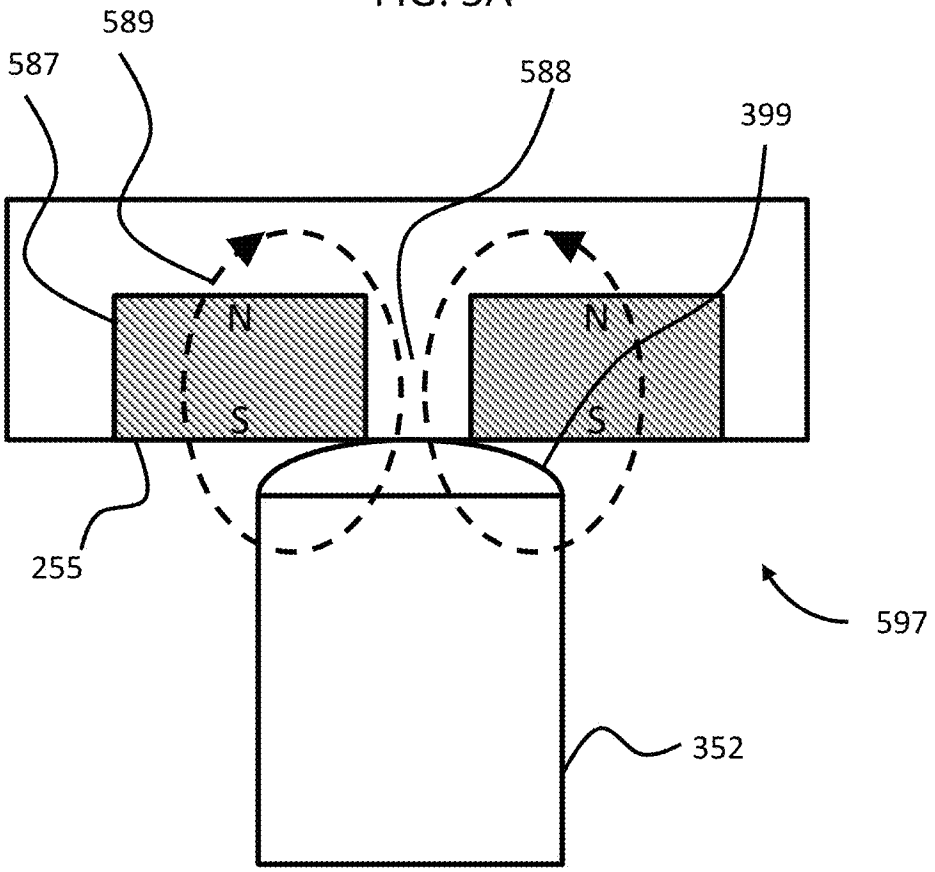
FIGS. 5A-5C depict exemplary magnet arrangements according to an exemplary embodiment.

FIG. 5A depicts an exemplary embodiment utilizing a plurality of separate permanent magnets 587. The plurality of separate permanent magnets 587 are embedded or otherwise surrounded by soft magnetic material 588 in this exemplary embodiment. In this regard, as can be seen, the magnetic flux 589 of the permanent magnets 587 is channeled such that the flux travels in a circuit that is symmetrical, at least relative to the plane of FIG. 5A. Specifically, as can be seen, the magnetic flux 589 is channeled in between the two permanent magnets. In an exemplary embodiment, the configuration of the components of FIG. 5A is such that the magnetic flux is rotationally symmetric. That said, in alternative embodiment, the magnetic flux need not be rotationally symmetric.

Figure 5B:
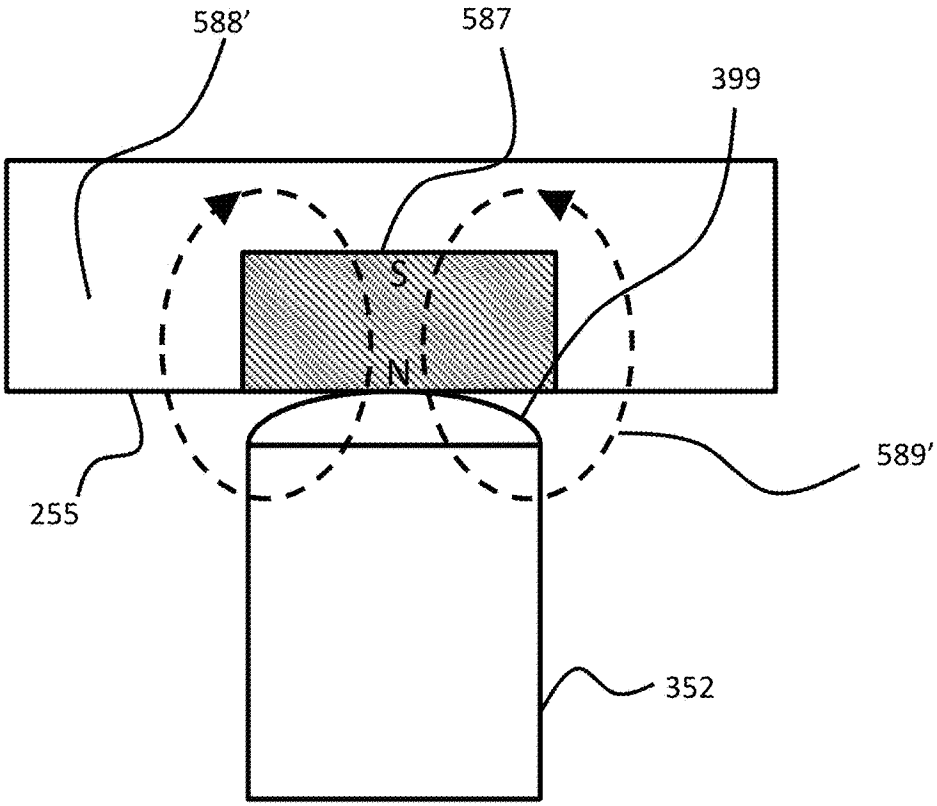
Figure 5C:
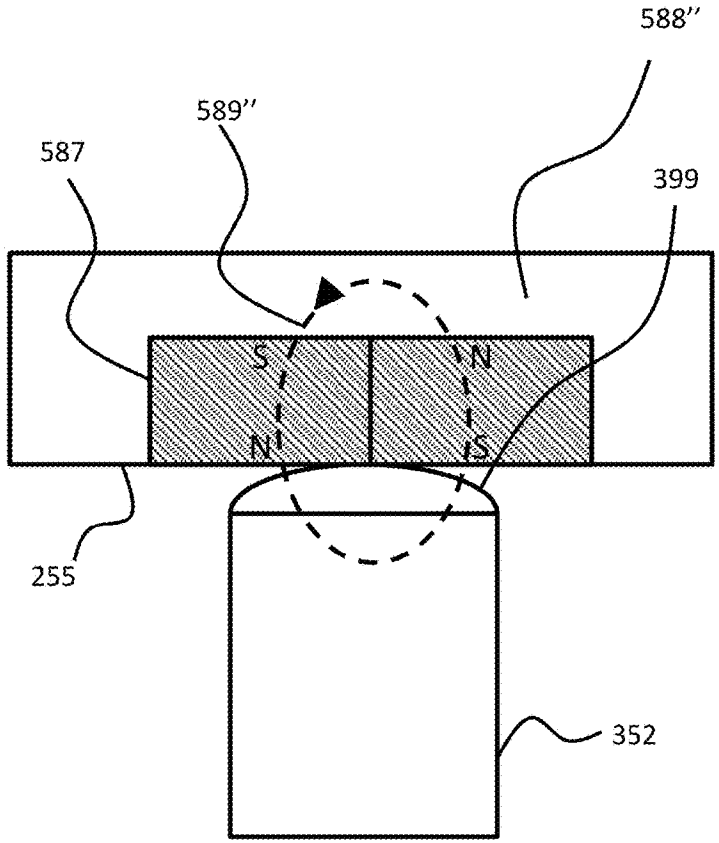

FIG. 5B depicts an alternate embodiment, where a single permanent magnet 587 is utilized to create magnetic flux 589', where the soft iron 588' of the BTE device 240 conducts the magnetic flux 589' in a rotationally symmetric manner. FIG. 5C depicts yet another alternate embodiment, where a plurality of permanent magnets 587 are embedded in a soft iron material 588, where the soft iron 588" channels the magnetic flux 589" as seen.

It is noted that alternative magnetic arrangements can be utilized. Any magnetic arrangement that can enable the teachings detailed herein and/or variations thereof to be practiced can be utilized in at least some embodiments In an exemplary embodiment, the curved contact surface 399 and/or the curved vibration transfer surface 255 results in a coupling surface combination where the attraction force between the surfaces varies relatively little, if at all, with respect to a change in the angle between the two coupling surfaces (e.g., the angle of the axis 301 relative to the normal direction of the surface 255) (e.g., the tangent plane of the local area of the surface 255 that is in direct contact with the surface 399), at least over the aforementioned angles of the axis 301 detailed above). In an exemplary embodiment, the attraction force is relatively constant over the various rotation angles, at least relative to that which would be the case if the surfaces 399 and 255 were flat over those same rotation angles. Indeed, in an exemplary embodiment, couplings where one or both surfaces are curved can provide a larger area of even or uniform attractive force, thus allowing more flexibility in the coupling for positioning of the BTE device 240 relative to the percutaneous vibration conductor 150. (Some additional information about the uniform coupling forces is provided below).

In this regard, the surfaces are coupled together by an effectively torque-free coupling (which includes a torque-free coupling). By torque-free coupling, it is meant that the surfaces are coupled to one another in a manner that prevents or otherwise does not permit the development of a torque (moment) to be established between the BTE device 240 and the percutaneous vibration conductor 150, at least for the rotation angles detailed herein.

In view of the above, it can be seen that an exemplary embodiment includes a prosthesis including an external component, such as, by way of example only and not by way of limitation, the BTE device 240, configured to output a signal in response to an external stimulus (e.g., a captured sound) and conductor component, such as, by way of example only and not by way of limitation, the percutaneous vibration conductor 150, coupled to the external component, configured to communicatively transfer the signal to a location below skin of the recipient, wherein the conductor component is coupled to the external component via an effectively torque-free coupling. In an exemplary embodiment, the coupling is a torque-free coupling. In an exemplary embodiment, the external component includes a first surface (e.g., surface 255), the conductor component includes a second surface (e.g., surface 399). The second surface directly contacts the first surface, and at least one of the first surface or the second surface is a curved surface (e.g., surface 399 and/or surface 255').

With reference to FIGS. 4H, 4I and 5A-5C, in an exemplary embodiment, the aforementioned torque-free coupling (and/or the aforementioned effectively torque-free coupling) is a magnetic coupling. The coupling is established by one or more permanent magnets located in at least one of the external component or the conductor component.

As detailed above, in an exemplary embodiment, surfaces establishing the coupling (e.g., surface 255 and surface 399) are rotationally symmetrical about an axis in a vicinity proximate the coupling. In an exemplary embodiment, the axis is an axis that is normal to the tangent plane of one or both of the surfaces at the location where the surfaces of the coupling contact one another. In an exemplary embodiment, the axis is axis 301 as detailed above.

Figure 6:
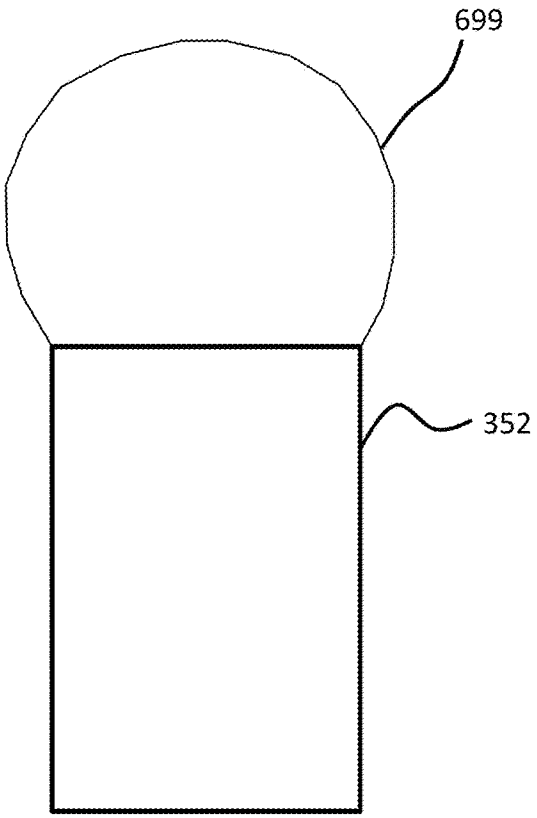
FIG. 6 depicts another exemplary contact surface of an exemplary embodiment of a vibration conductor.

As detailed above, the contact surface of the vibration conductor 350 and/or the vibration transfer surface 255 of the BTE device 240 can be curved or can be flat. Accordingly, in at least some embodiments, the contact surface and/or the vibration transfer surface are uniform surfaces. That said, as noted above, in alternative embodiment of at least the vibration transfer surface 255 can be a combined flat and curved surface. Thus, in an exemplary embodiment, the vibration transfer surface 255 is a non-uniform surface. In a similar vein, in an exemplary embodiment, the contact surface of the vibration conductor 350 can be a surface made up of flat and curved surfaces, and thus the contact surface thereof can be a non-uniform surface. Still further, it is noted that the contact surface and/or the vibration transfer surface can be practiced utilizing faceted surfaces. By way of example only and not by way of limitation, FIG. 6 depicts an exemplary quasi-functional schematic of a faceted contact surface 699. Accordingly, the facets provide a localized flat surface, but in the global context, and effectively curved surface. Thus, while there will be a modicum of torque that can be created via the coupling of the surface 699 to the surface 255 of the BTE device, the torque will be minimal and short-lived upon relative movement (rotation/rocking) of the two surfaces. This is an example of a coupling that is at least effectively torque-free.

Accordingly, in an exemplary embodiment, the external component includes a first surface (e.g., surface 255), the conductor component includes a second surface (e.g., surface 399). The second surface directly contacts the first surface, and at least one of the first surface or the second surface is a non-uniform surface (e.g., surface 399).

Figure 7A:
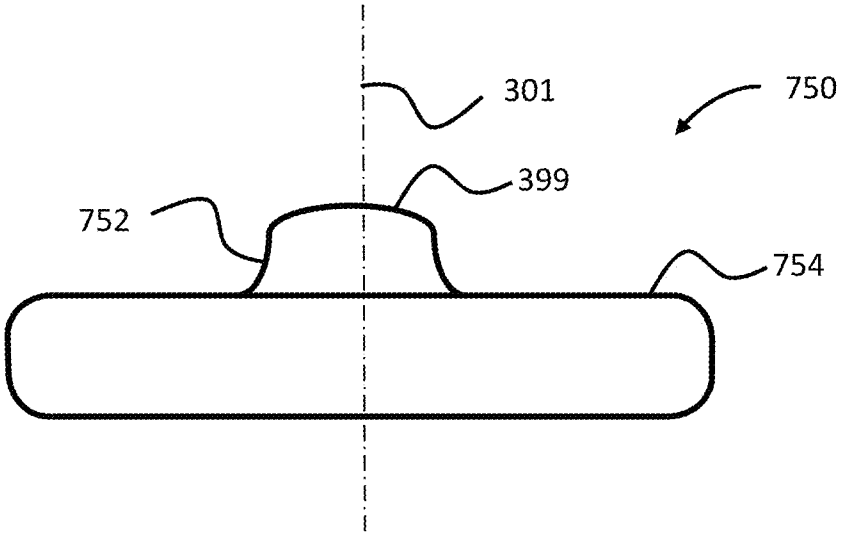
FIGS. 7A and 7B depict an exemplary transcutaneous vibration conductor according to an exemplary embodiment.
Figure 7B:
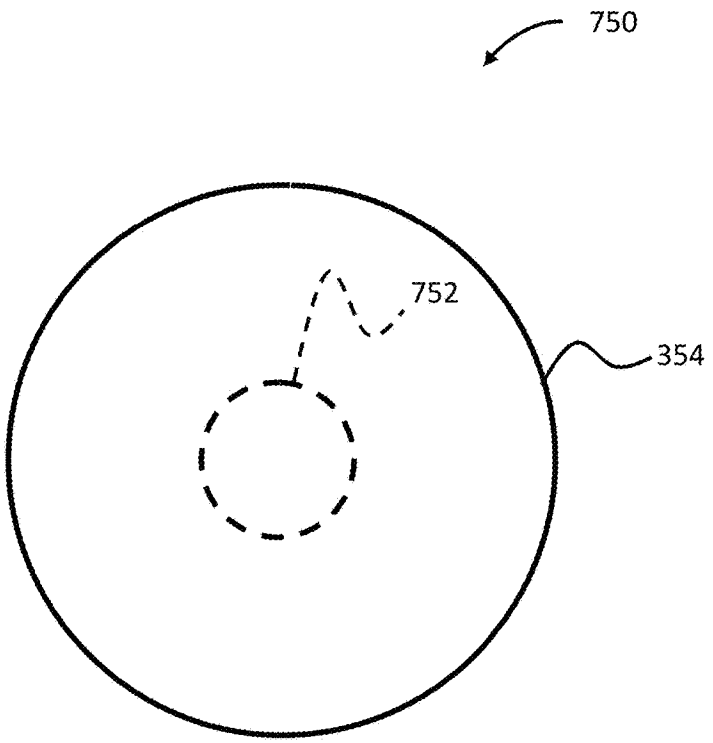

The embodiments detailed above are directed towards a percutaneous vibration conductor 350. That said, the teachings detailed herein, in at least some instances can be applied to a transcutaneous vibration conductor. Broadly speaking, with respect to the conductor component mentioned above, an exemplary embodiment includes a conductor component coupled to the external component (e.g. the BTE device 240) configured to communicatively transfer vibrations to a location at the skin of the recipient, such as to the surface of the skin of the recipient. In this regard, FIGS. 7A and 7B depict an exemplary embodiment of a transcutaneous vibration conductor 750. FIG. 7A is a side view of the exemplary transcutaneous vibrational conductor 750, and FIG. 7B is a bottom view of the conductor 750. As can be seen, the transcutaneous vibration conductor 750 includes a mound 752 that extends in the longitudinal direction of the transcutaneous vibration conductor 750 from a platform 754 that extends in the lateral direction away from the mound 752. Details of how the transcutaneous vibration conductor 750 interfaces with the anatomy of the recipient are provided in greater detail below. The structure of the percutaneous vibration conductor 750 will first be described. It is noted at this time that any teaching detailed herein with respect to a percutaneous vibration conductor, at least with respect to the coupling features thereof (e.g., the contact surface and the vibration transfer surface) is also applicable to a transcutaneous vibration conductor, and vice versa unless otherwise specified.

In an exemplary embodiment, the outer profile of the transcutaneous vibration conductor 750 is that of an inverted stool shape having a circular seat. In an alternate embodiment, the outer profile of the transcutaneous vibration conductor 350 is that of an inverted "T" shape or an inverted "L" shape. With respect to the embodiment specifically depicted in FIGS. 7A and 7B, the outer profile of the transcutaneous vibration conductor 750 is such that the mound 752 is centered with respect to the circular platform 754. In this regard, the portions of the platform 754 extend in opposite directions away from the mound 752. That said, in an alternate embodiment, the portions of a platform 754 can extend in opposite directions away from the mound 752 in non-equal distances such that the mound 752 is not centered relative to the outer periphery of the platform 754. Further, it is noted that the embodiment depicted in FIGS. 7A and 7B utilizes a mound 752 instead of a shaft (e.g., shaft 352 of FIGS. 3A and 3B), although in other embodiments, a shaft can be used. Any configuration of a transcutaneous vibration conductor 750 that can enable the teachings detailed herein and/or variations thereof to be practiced can be utilized in at least some embodiments. In the exemplary embodiment of FIGS. 7A and 7B, the mound 752 is of sufficient length such that the platform is located against the outer surface of the skin of the recipient (e.g., the skin that is above the mastoid bone) when the surface 399 is coupled to the BTE device 240. That is, the contact surface 399 at the end of the mound 752 can abut the BTE device such that vibrations generated by the BTE device can be directly conducted directly from the BTE device to the transcutaneous vibration conductor 750 to thereby evoke a bone conduction hearing percept via passive transcutaneous bone conduction. In this regard, the contact surface can be any of the surfaces as detailed above with respect to the contact surfaces of the percutaneous vibration conductor, providing that the surface that can enable such conduction to take place and can enable the teachings detailed herein and are variations thereof to be practiced.

In an exemplary embodiment, the bottom (i.e., the side facing the skin of the recipient when attached to the BTE device 240, which is the side depicted in FIG. 7B) of the platform 754 is configured to surface mount/sit on skin of the recipient. Any configuration of the transcutaneous vibration conductor 750 that can enable passive transcutaneous bone conduction to take place with a coupling in accordance with the teachings detailed herein can be utilized in at least some embodiments.

Figure 8:
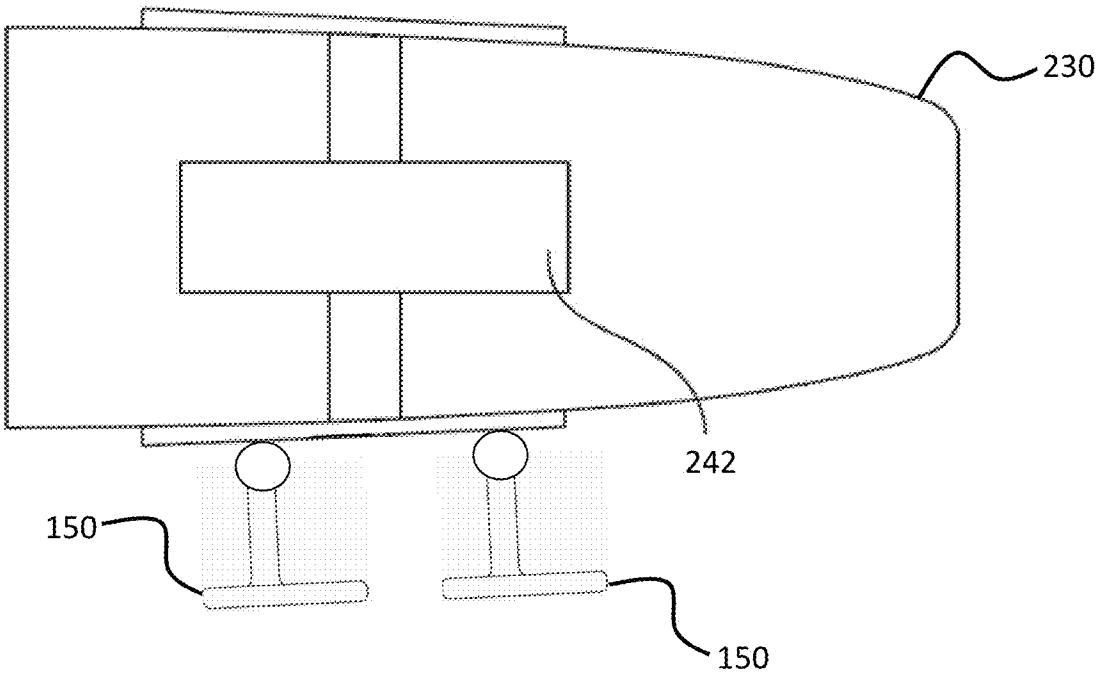
FIG. 8 depicts the portion of the BTE device depicted in FIG. 2B in contact with a plurality of vibration conductors.

It is further noted that at least some embodiments of the teachings detailed herein have utilitarian value with respect to the ability to utilize a plurality of conductor components, whether they be percutaneous vibration conductors or transcutaneous vibration conductors. In this regard, FIG. 8 depicts an exemplary embodiment where two vibration conductors 150 are connected to spine 230 of BTE device 240. More specifically, because of the torque-free coupling, the alignment (e.g., angle relative to the tangent plane of the pertinent surface(s) of the shafts (or mounds) of the conductors (or the alignment of the conductors in general) need not be precisely controlled to obtain a coupling that can at least effectively transmit vibrations from the BTE device 240 to the conductor to effectively evoke a hearing percept utilizing bone conduction. Thus, there can be "play" between the components, permitting the components to self-adjust to a relaxed state without the creation of torque, or at least the effective creation of torque. Put another way, because there is no specific alignment that is required between the conductors and the BTE device 240, there is no alignment that is required between the giving conductors, and thus the conductors can be utilized in a global manner without regard to the specific local manner in which a given conductor is utilized relative to the specific local manner in which another conductor is utilized. That is, the alignments of two conductors need not be synchronized with one another, as would be the case with respect to, for example, utilization of two snap couplings for two conductors (or two holes in the BTE device 240 to receive two conductors, etc.), where both conductors must be precisely aligned with the BTE device 240. Accordingly, an exemplary embodiment includes a device having at least two conductor components, wherein the conductor component is coupled to the external component via an effectively torque-free coupling.

Figure 9:
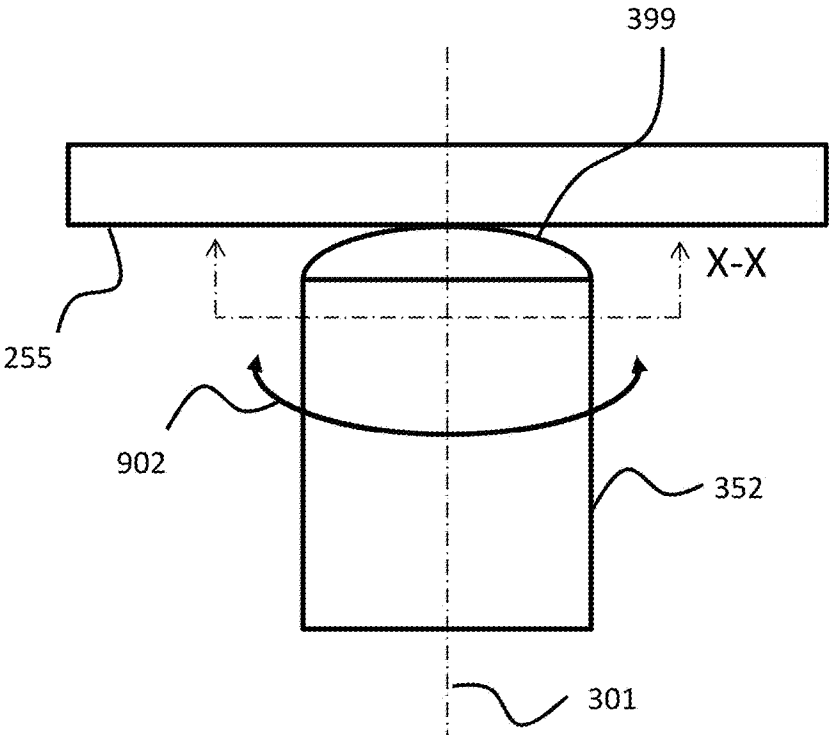
FIGS. 9 and 10 depict exemplary movement scenarios of the vibration conductor relative to the BTE device according to an exemplary embodiment.
Figure 10:
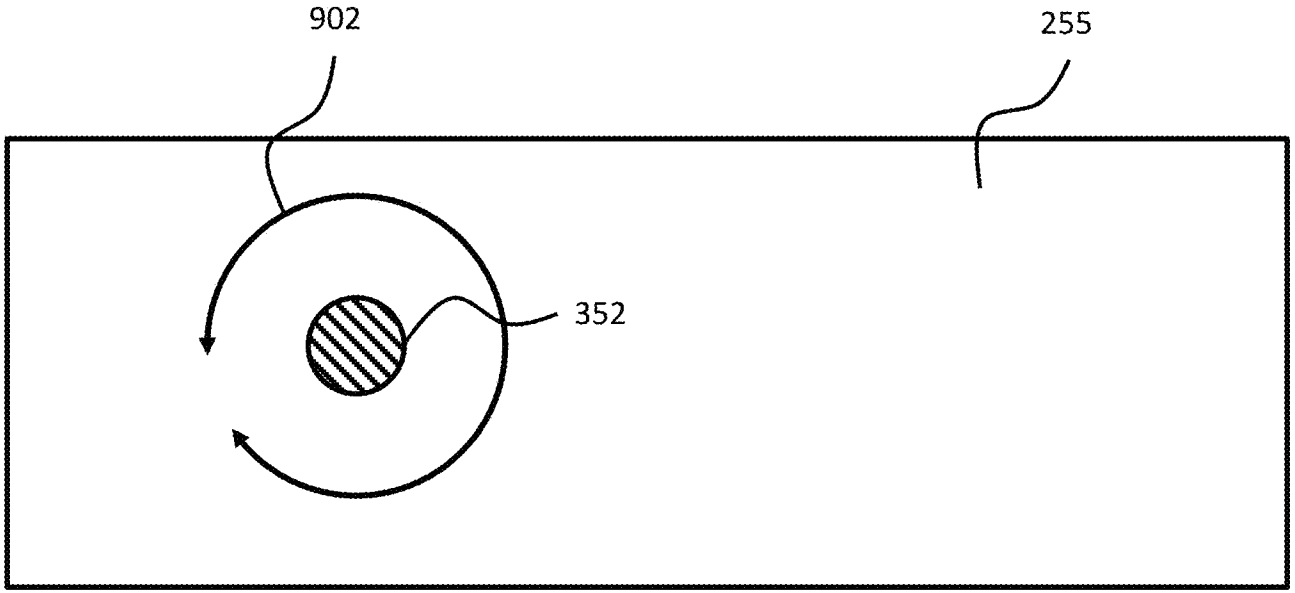

It is noted that an exemplary embodiment utilizing the surfaces 399 and 255 (or any of the surfaces detailed herein) and/or the torque-free coupling detailed herein also enables relative rotation between the respective surfaces about the longitudinal axis of the vibration conductor. More specifically, referring now to FIG. 9, it can be seen that shaft 352 can rotate about the axis 301, as indicated by the arrow 902, in two directions. This is also the case if the contact surface 399 is flat or not curved. FIG. 10 also details this feature, which shows a cross-sectional view of shaft 352 looking down onto the plane of vibration transfer surface 255 (in the scenario where vibration transfer surface 255 is a flat surface), with arrow 902 showing the relative rotation that the shaft 352 (and thus the vibration conductor) is configured to have relative to one another. It is noted that "relative rotation" includes rotation where the surface 255 rotates and the vibration conductor 399 is fixed, and vice-versa.

Accordingly, in an exemplary embodiment, there is a prosthesis, such as a percutaneous bone conduction device or a passive transcutaneous bone conduction device including an external component (e.g., BTE device 240) configured to output a signal (e.g., a vibrational signal) in response to an external stimulus and a vibration transfer component (e.g., a skin penetrating component) configured to communicatively transfer the signal at least one of to or partially beneath skin of the recipient. The prosthesis is configured such that the vibration transfer component can move in a plurality of degrees of freedom relative to the external component while retained to the external component. For example, the vibration transfer component can move in at least two degrees of freedom. For example, the component can rotate in the plane of FIGS. 4A-4B, as depicted in those FIGs., and in the plane normal to the plane of FIGS. 4A-4B. Alternatively, the component can rotate the plane of FIGS. 4A-4B or rotate in the plane normal to the plane of those FIGs., and rotate about the axis 301 as depicted in FIGS. 9 and 10.

Still further by way of example only and not by way of limitation, the vibration transfer component can move in at least three degrees of freedom. For example, the component can rotate in the plane of FIGS. 4A-4B, as depicted in those FIGs. and in the plane normal to the plane of FIGS. 4A-4B, and rotate about the axis 301 as depicted in FIGS. 9 and 10.

That said, it is also noted that in at least some embodiments, the prosthesis is configured such that there is only movement in one degree of freedom, such as by way of example only and not by way limitation, rotation in the plane of FIGS. 4A and 4B or in the plane normal to those FIGS.

There will be instances where the differences in the placement of the vibration conductor with respect to the pinna result in a different orientation of the vibration conductor relative to the BTE device. This difference can result in the angle between the tangent surface and/or the angle about the longitudinal axis being different from recipient to recipient, and/or being different for the same recipient over time. The above-detailed torque-free coupling, whether it provides one, two or three degrees of freedom, can enable this difference to be accommodated.

In at least some embodiments, the prosthesis is configured such that there can be relative movement of the vibration transfer component and the external component in more than three degrees of freedom and/or in other manners than those just detailed. Some exemplary embodiments of this will now be explained.

Figure 11A:
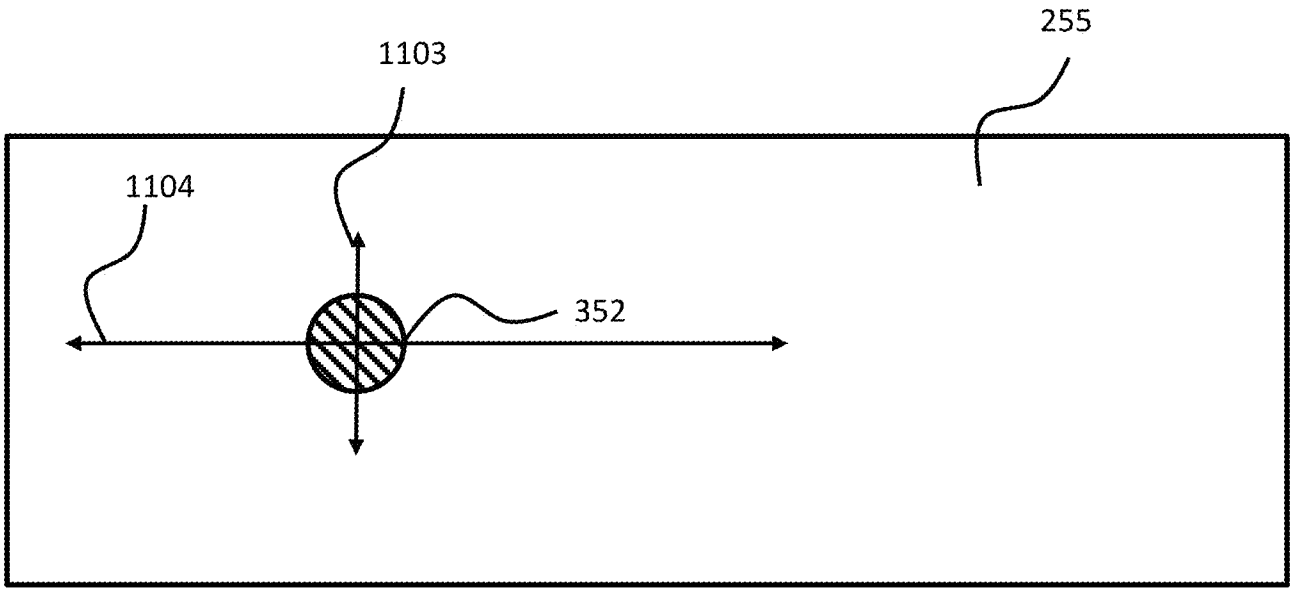
FIGS. 11A and 11B depict other exemplary movement scenarios of the vibration conductor relative to the BTE device according to an exemplary embodiment.

Referring now to FIG. 11A, there is depicted a functional schematic corresponding to the view of FIG. 10, except detailing that the shaft 352 (which represents any vibration conductor detailed herein and/or variations thereof) is coupled to the BTE device 240 such that the shaft 352 in general, and the surface 399 (or other surface detailed herein, including a flat surface), can slide relative to the vibration transfer surface 255 (which includes sliding of the vibration transfer surface 255 relative to the shaft 352). As is functionally depicted by arrows 1103 and 1104 in FIG. 11A, the vibration transfer surface 255 can move in one or two degrees of freedom in the direction of the plane of the vibration transfer surface 255 relative to the shaft 352 and/or visa-versa, while the vibration conductor 350 is coupled to the BTE device 240.

Figure 11B:
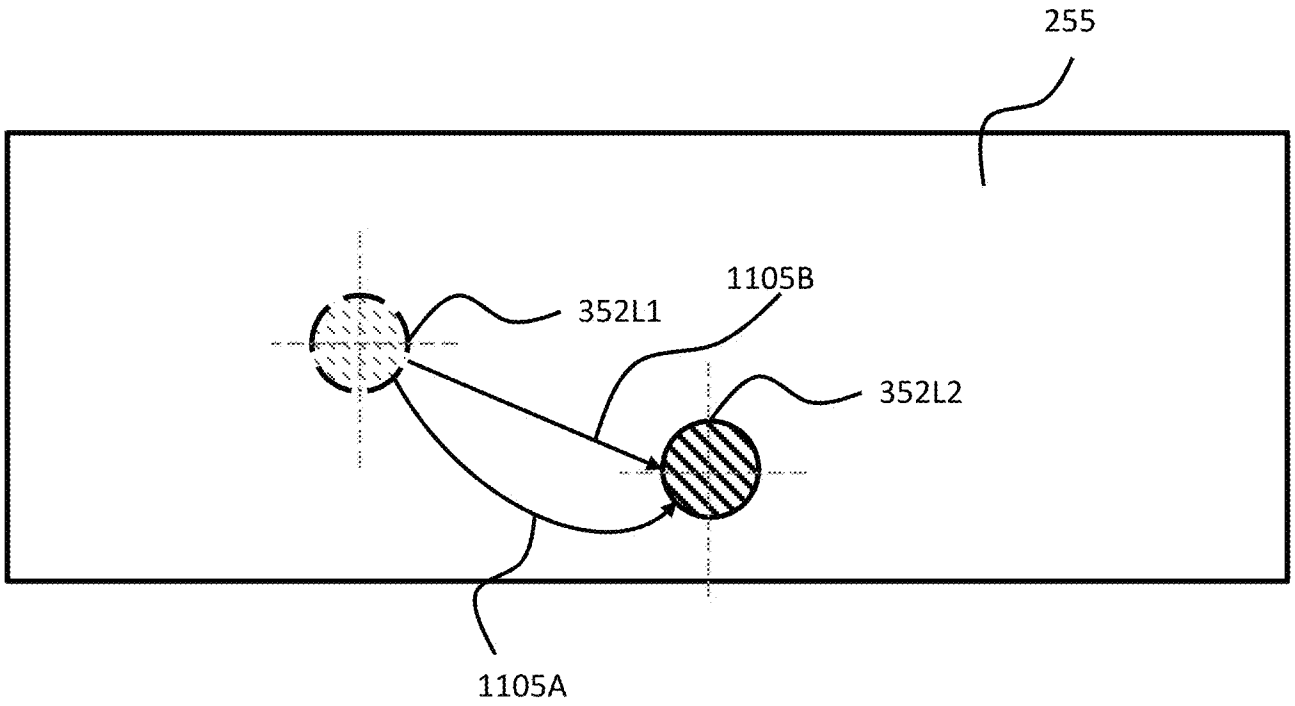

FIG. 11B provides two exemplary scenarios of movement of the vibration conductor, which depicts shaft 352 moving from a location (352L1) to a location (352L2) on the vibration transfer surface along a vector trajectory (vector 1105B), and along an arcuate trajectory (arc 1105A), both trajectories being examples of trajectories that can be obtained utilizing a prosthesis that is configured to permit the vibration conductor to move in two degrees of freedom relative to the BTE device. The vector trajectory 1105B is a two degree of freedom movement because the two dimensional Cartesian coordinates have two axes that are not aligned with the vector 1105B. It is noted that any disclosure of movement of the vibration conductor relative to the BTE device also corresponds to the converse; movement of the BTE device relative to the vibration conductor. It is also noted that any disclosure of movement of one of the other corresponds to movement of both (e.g., movement of the BTE device in one direction and movement of the vibration conductor in another direction that is different than that one direction).

Is noted that in an exemplary embodiment, the prosthesis is configured such that the vibration conductor is coupled to the BTE device at all locations along the trajectory of sliding from location 352 L1 to location 352 L2. That is, the prosthesis is configured to maintain a coupling along an infinite number of points along a trajectory of sliding.

Figure 11C:
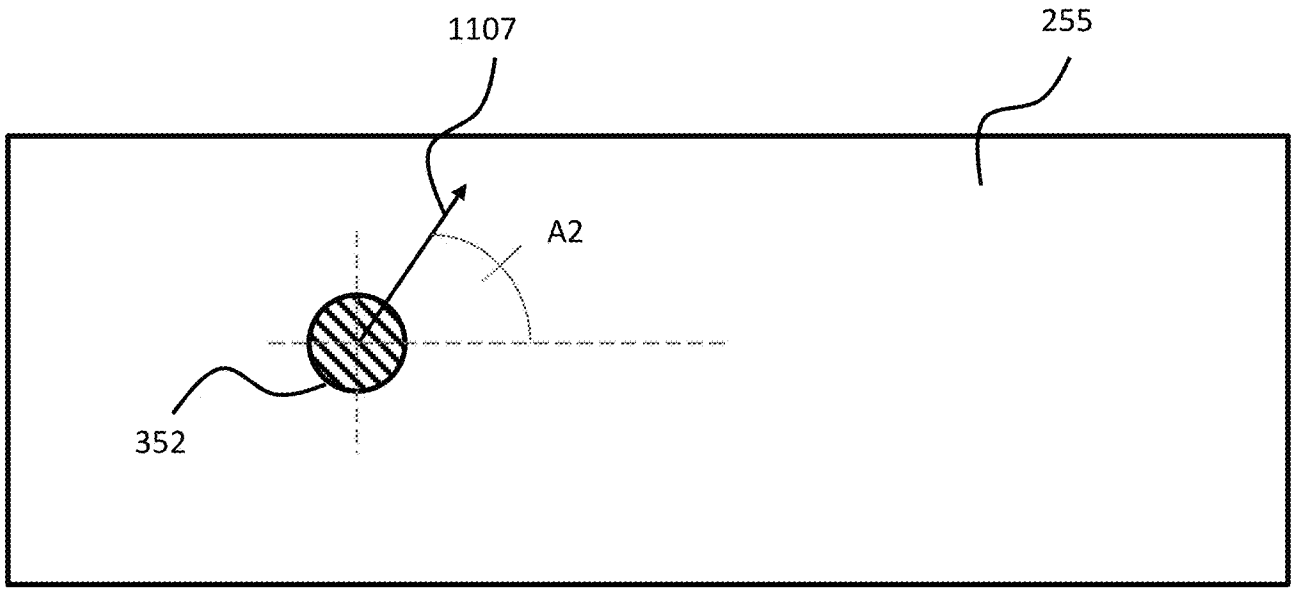
FIG. 11C depict a frame of reference to detail exemplary movement scenarios of the vibration conductor relative to the BTE device according to an exemplary embodiment.

Briefly, it is noted that embodiments of at least some hearing prostheses are configured to provide the sliding movement in a manner that enables the vibration conductor (e.g., a skin penetrating component) to relatively move laterally (which includes movement of the vibration conductor relative to a stationary BTE device, movement of the BTE device relative to a stationary vibration conductor, and movement of the BTE device relative to a moving vibration conductor) in at least one direction along the BTE device (or other external component) while retained (e.g., coupled according to the teachings detailed herein or other coupling arrangements that enable the teachings detailed herein) to the BTE device. It is further noted that in at least some embodiments, the prosthesis is configured to provide the sliding movement in a manner that enables the vibration conductor to relatively move laterally in an infinite number of directions along the BTE device or other external component while retained to the BTE device. For example, with respect to FIG. 11C, where vector 1107 indicates a vector direction of movement of the vibration conductor relative to the surface 255, the angle A2 can be any angle between and including 0 to 360 degrees, in any fraction thereof. That is, the angle A2 can be any angle in at least some embodiments.

As with the embodiment detailed above with respect to the torque-free coupling, there will be instances where the differences in the placement of the vibration conductor with respect to the pinna result in a different orientation of the vibration conductor relative to the BTE device. These differences can result in differences between the contact location of the vibration conductor to the BTE device 240, because the BTE device 240 hangs over the pinna and extends in back of the pinna. This difference can exist from recipient to recipient, and with the same recipient over time. Utilizing a coupling that permits movement as detailed in FIG. 11A, in one or two degrees of freedom, allows the vibration conductor to be attached to the BTE device at more locations (e.g., over a larger area of surface 255) than that would be the case with respect to a coupling that does not permit the movements as detailed in FIG. 11A.

While the above exemplary movement of the vibration conductor relative to the BTE device is an example of a prosthesis that enables movement in two degrees of freedom, embodiments that combine configurations enabling this movement with the embodiment detailed above with respect to the torque-free coupling can enable relative movement between the pertinent components in more than two degrees of freedom. By way of example only and not by way of limitation, a prosthesis that enables relative movement according to FIGS. 11A and 11B and enables movement according to FIGS. 4A and 4B will enable relative movement in at least three degrees of freedom. (That said, an exemplary embodiment that enables movement between the pertinent components according to only one of the degrees of freedom represented in FIGS. 11A and 11B and only one degree of freedom with respect to rotation (the plane of FIGS. 4A and 4B, the plane normal to those FIGs. or rotation in the plane of FIG. 9) would enable relative movement in two degrees of freedom.) Alternatively, by way of example only and not by way limitation, a prosthesis that enables relative movement according to FIGS. 11A and 11B and enables movement with respect to rotation of the components in the plane normal to FIGS. 4A and 4B will also enable relative movement in three degrees of freedom. Still further by way of example only and not by way limitation, a prosthesis that enables relative movement according to FIGS. 11A and 11B and enables movement with respect to rotation of the components in the plane of FIG. 9 will also enable relative movement in three degrees of freedom.

Still further, embodiments that combine configurations enabling the embodiments of FIGS. 11A and 11B detailed above with respect to the torque-free coupling can enable relative movement between the pertinent components in more than three degrees of freedom. By way of example only and not by way of limitation, a prosthesis that enables relative movement according to FIGS. 11A and 11B and enables movement according to FIGS. 4A and 4B and movement according to rotation in the plane offset (e.g., normal) to that plane will enable relative movement in four degrees of freedom. Alternatively, by way of example only and not by way limitation, a prosthesis that enables relative movement according to FIGS. 11A and 11B and enables movement with respect to rotation of the components in the plane of FIGS. 4A and 4B or in a plane offset from that plane and in the plane of FIG. 9 will also enable relative movement in four degrees of freedom. Still further by way of example only and not by way limitation, a prosthesis that enables relative movement according to FIGS. 11A and 11B but in only one degree of freedom with respect thereto and enables movement with respect to rotation of the components in the plane of FIG. 9, rotation in the plane of FIGS. 4A and 4B and rotation in a plane offset therefrom will also enable relative movement in four degrees of freedom.

Also, embodiments that combine configurations enabling the movements of embodiments of FIGS. 11A and 11B detailed above with respect to the torque-free coupling can enable relative movement between the pertinent components in more than four degrees of freedom. By way of example only and not by way of limitation, a prosthesis that enables relative movement according to FIGS. 11A and 11B and enables movement according to FIGS. 4A and 4B and movement according to rotation in the plane offset to that plane and rotation in the plane of FIG. 9 will enable relative movement in five degrees of freedom. Thus, in view of the above, it can be seen that in an exemplary embodiment, at least one of the external component or the skin penetrating component includes a permanent magnet, and at least one of the other components of the external component or the skin penetrating component includes a surface having contours configured to permit the skin penetrating component to be coupled to the external component at least one of in a plurality of locations on the first side or in a plurality of orientations at a given location on the first side.

In at least some embodiments, movement in the sixth degree of freedom (i.e. towards and away from the surface 255 along a direction that is normal to a tangent plane of the surface 255 (e.g., to the left and right in FIG. 2A)) is prevented. However, in some other embodiments, movement in that direction, least in part, can be enabled according to another exemplary embodiment. By way of example only and not by way of limitation, the shaft 352 can be configured to telescope along the axis 301, thereby permitting movement of the respective platforms relative to the BTE device 240 in a direction normal to the plane of the vibration transfer surface 255 (with respect to embodiments where the surface 255 is flat). While this does not correspond to complete movement in a sixth degree of freedom because the contact surface of the vibration conductor does not move relative to the vibration transfer surface of the BTE device, this does correspond to movement with respect to the components connected to the telescoping shaft 342.

By way of example only and not by way of limitation, any magnetic arrangement can be utilized to provide an attraction force between the vibration conductor 150 and the BTE device 240 that is sufficient to couple the two components together, but also is such that friction forces between the contact surface (e.g., surface 399) and the vibration transfer surface (e.g., surface 255) can be overcome to permit the movement in the two degrees of freedom shown in FIG. 11A. An exemplary magnetic arrangement that can enable the coupled movement as detailed in FIGS. 11A and 11B will now be described.

In at least some embodiments, the magnetic arrangements detailed above can be utilized to provide the sliding movement. That said, in an alternate embodiment, the sliding movement can be enabled via a magnetic coupling with an array of magnetic poles, which, by way of example only and not by way of limitation, can be a polymagnet array, such as that available from Correlated Magnetics. In an exemplary embodiment, the array is a symmetric array of magnetic poles.

Figure 12:
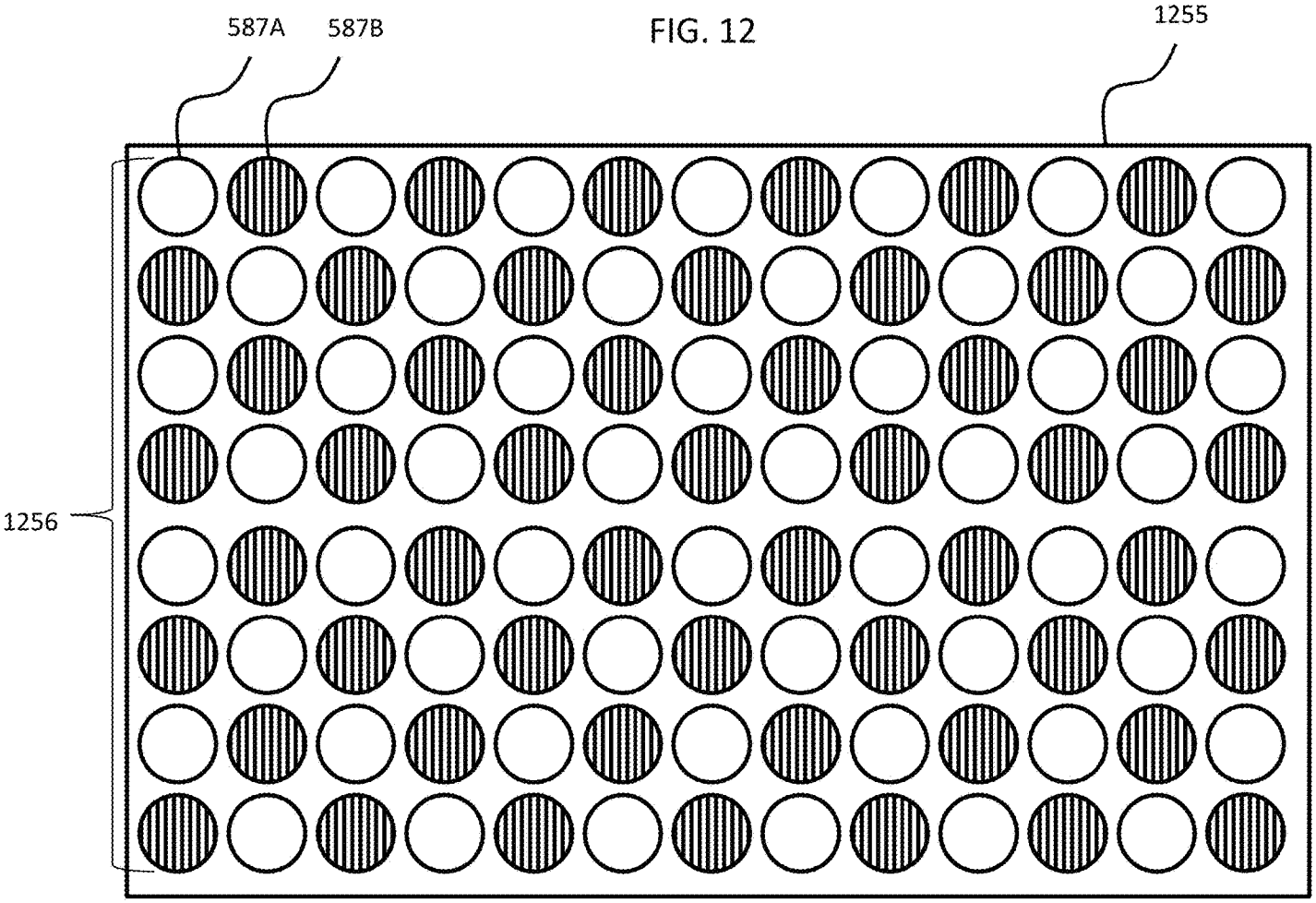
FIG. 12 depicts an exemplary embodiment of a portion of the BTE device.

FIG. 12 depicts an exemplary functional view of a vibration transfer surface 1255 corresponding to the vibration transfer surface 255 detailed above or any of the other surfaces detailed herein or variations thereof, having an array of magnets 1256 establishing magnetic poles. With respect to FIG. 12, the magnets 587A (non-hatched magnets) correspond to magnets having south poles closest to the surface 1255 (i.e., closest to the contact surface 399 when the contact surface 399 is coupled thereto), and magnets 587B (the hatched magnets) correspond to magnets having north poles closest to the surface 1255. Collectively, the array 1256 corresponds to an array of magnetic poles of alternating polarity. (It is noted that while the array 1256 of FIG. 12 is shown with the magnets spaced apart from one another, in an alternative embodiment, the magnets can be in contact with one another).

Figure 13A:
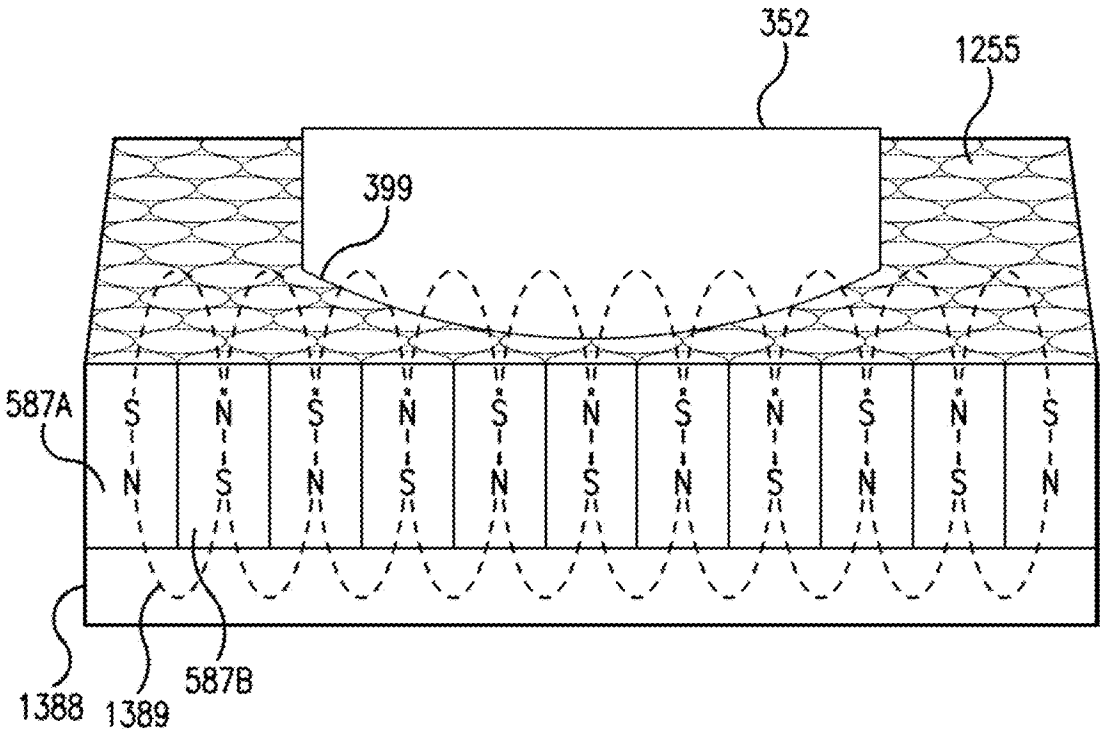
FIG. 13A depicts another exemplary embodiment of a portion of the BTE device.

In an exemplary embodiment, the surface 255 of the BTE device is made up at least in part of the array of magnets (e.g., the ends of the magnets form at least part of the surface). In this regard, FIG. 13A depicts a cross-sectional isometric view of a portion of the BTE device 240, showing magnets 587A and 587B forming part of the vibration transfer surface 1255 (and thus vibration transfer surface 255) and the surface 399 of shaft 352 being in direct contact with that surface and magnetically attracted thereto owing to the fact that at least a portion of the shaft 352 is made of soft magnetic material such as iron. Indeed, as can be seen, at least some of the magnetic fluxes 1389 are seen interacting with the respective magnets and the soft magnetic material of the shaft 352, thereby creating an attraction between the BTE device 240 and the vibration conductor 150, and thereby coupling the two components together in a manner concomitant with the teachings detailed herein.

Also as seen in FIG. 13A, a soft magnetic backplate 1388 (an optional feature) is present between the magnets of the array and the other components of the BTE device (e.g., the vibratory actuator 242). In an exemplary embodiment, the soft magnetic backplate 1388 channels the magnetic fluxes 1389 so that a substantial amount of the fluxes do not extend into the BTE device, or at least do not extend into the BTE device to a component that can be deleteriously affected by the magnetic fluxes. Some additional details of this feature are described below.

In an exemplary embodiment, the magnets have a round cross-section with respect to a plane that is normal to the longitudinal axis of the respective magnets. In an alternative embodiment, the magnets have a rectangular cross-section (e.g., a square cross-section) in that plane. With respect to the latter configuration, in at least some embodiments, there will be little to no non-magnet space between the magnets. With respect to the former configuration, there will inevitably be some space between the magnets, owing to the fact that all surfaces curve away from one another. In at least some embodiments, the spaces between the magnets can be filled, at least proximate the surface 1255 with a material (e.g., a non-magnetic material, such as plastic or the like, or a soft magnetic material, such as soft iron) so as to provide a more smooth surface to avoid the entrapment of material therein. That said, in an alternative embodiment, a material covers the ends of the magnets. That is, the surface 1255 (corresponding to surface 255 of FIGS. 2A-2C) is not established by the ends of the magnets, but by a material that covers the ends of the magnets that is thin enough or otherwise of a configuration that will not substantially or effectively disrupt the magnetic flux 1389 in a manner that will result in a non-utilitarian coupling between the vibration conductor and the BTE device 240. In an exemplary embodiment, the ends of the magnets are covered by a shim having a utilitarian surface, such as any of the curved surfaces detailed herein.

It is noted that the array 1256 of FIG. 12 can be located on a plurality of locations on the BTE device 240. In an exemplary embodiment, the array can be provided at both sides of the BTE device (e.g., at both surfaces 255 of the spine 230 in FIG. 2A). That said, in an alternate embodiment, the array is only located on one side of the BTE device. In some embodiments, the array covers only a portion of a given side of the BTE device and/or spline of the BTE device, while in other embodiments, the array covers the entire side of the BTE device and/or spline of the BTE device. Any application of the array that will enable the teachings detailed herein and/or variations thereof to be practiced can be utilized in at least some embodiments.

Figure 13B:
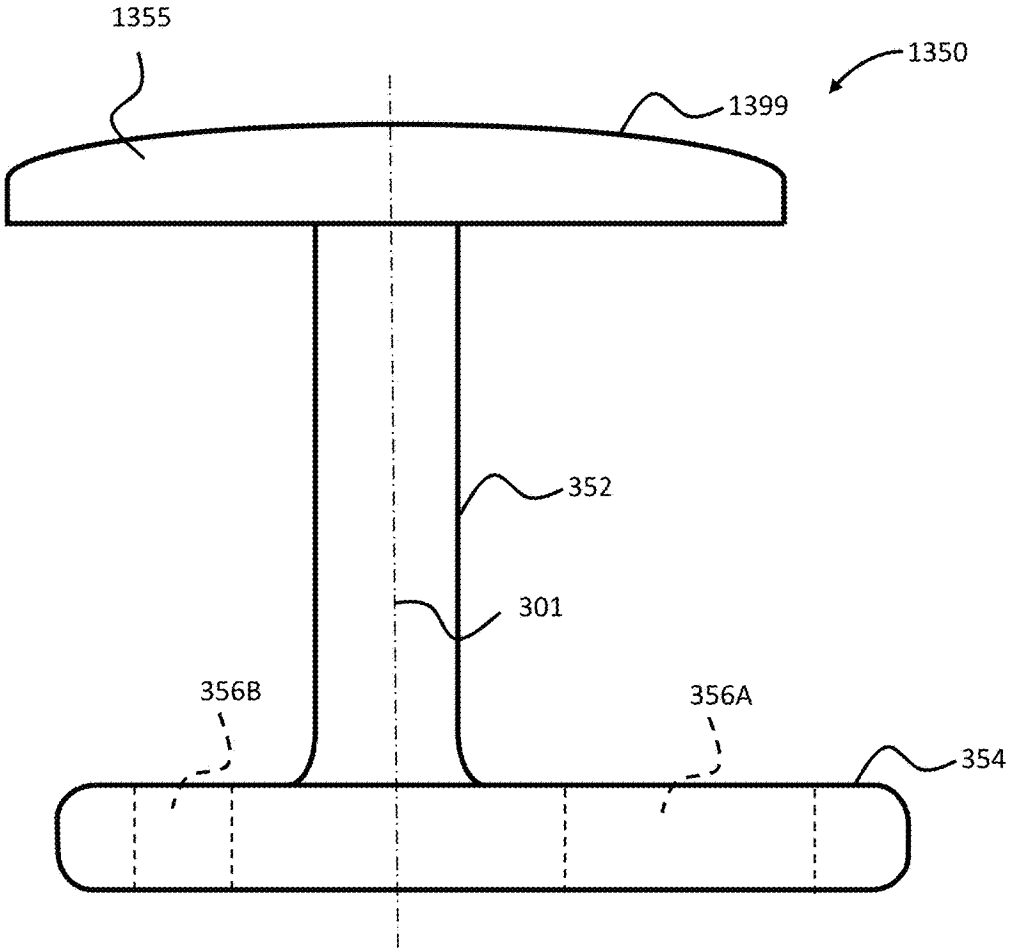
FIG. 13B depicts an alternate exemplary embodiment of a percutaneous vibration conductor.
Figure 13C:
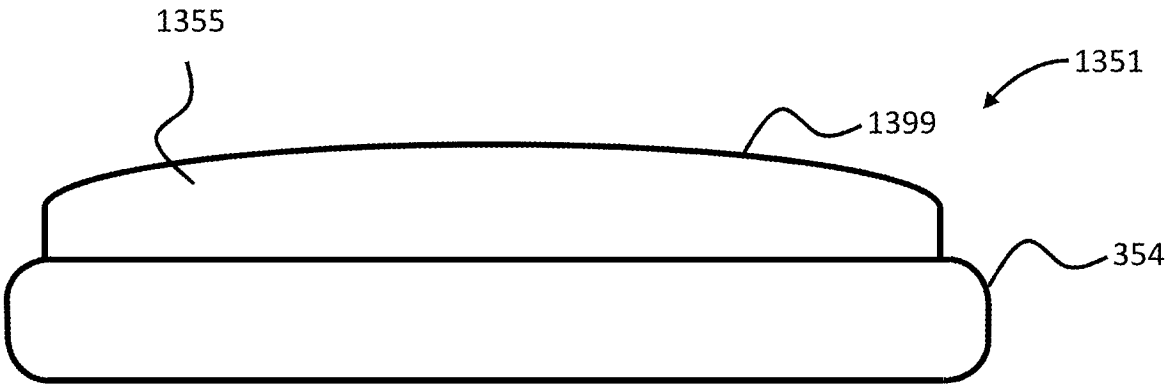
FIG. 13C depicts an alternate exemplary embodiment of a transcutaneous vibration conductor.

It is further noted that while the arrays of magnets detailed herein are presented in terms of being located on the BTE device, in an alternative embodiment, the arrays of magnets can be located on the vibration conductor. Indeed, in an exemplary embodiment, the surface 255 can be made up of a soft magnetic plate (flat or curved) instead of the arrays of magnets, where the array of magnets is located on the vibration conductor. In an exemplary embodiment, the portion of the vibration conductor that interfaces with the BTE device can have an extended service area relative to that of the embodiments of FIGS. 3A and 3B. By way of example only and not by way of limitation, FIG. 13B presents one exemplary embodiment of a percutaneous vibration conductor 1350 which includes a platform 1355 that extends away from the longitudinal axis 301 a distance that enables the array of magnets (not shown) to be arrayed in a manner that parallels the surface 1399, which can correspond to any of the surfaces detailed herein and/or variations thereof, including a flat surface. In this regard, it is noted that the magnet arrays detailed herein and/or variations thereof can be presented such that the poles are slightly angled relative to one another and/or such that the top surface of the array is curved, such that the curvature of surface 1399 can be achieved. FIG. 13C presents one embodiment of an exemplary transcutaneous vibration conductor 1351, where the platform 1355 is mounted directly to the platform 354. The utilitarian features associated with the platform 1355 utilized in the percutaneous vibration conductor 1350 can, at least in some embodiments, be realized utilizing the configuration of FIG. 13B.

In an exemplary embodiment, the arrays of magnets can be located on both the BTE device and the vibration conductor. Further it is noted that in at least some embodiments, an array can be utilized on one component and a single magnet or a plurality of magnets arranged in a non-arrayed manner can be utilized on another component.

Figure 14A:
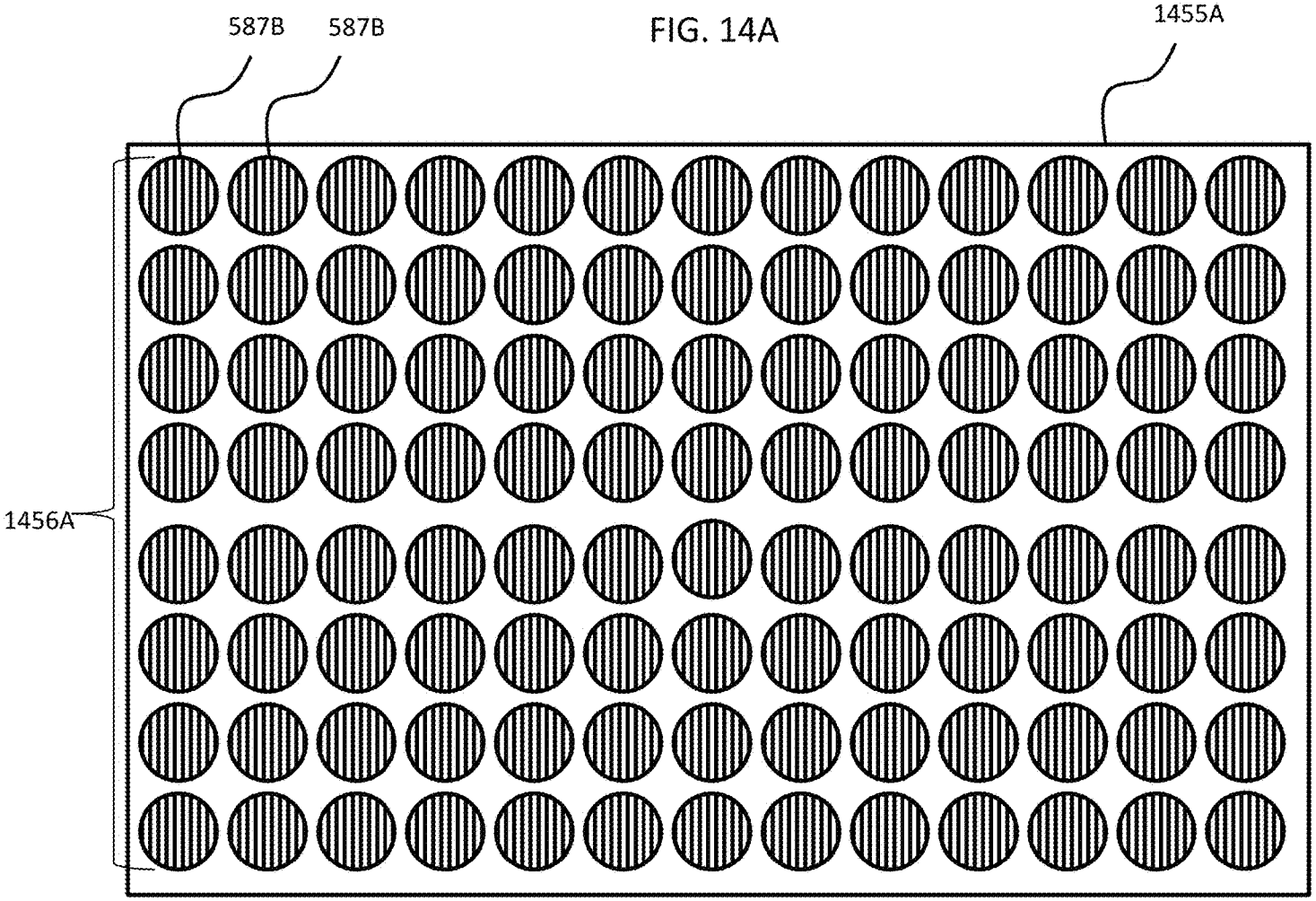
FIG. 14A depicts another exemplary embodiment of a portion of the BTE device.
Figure 14B:
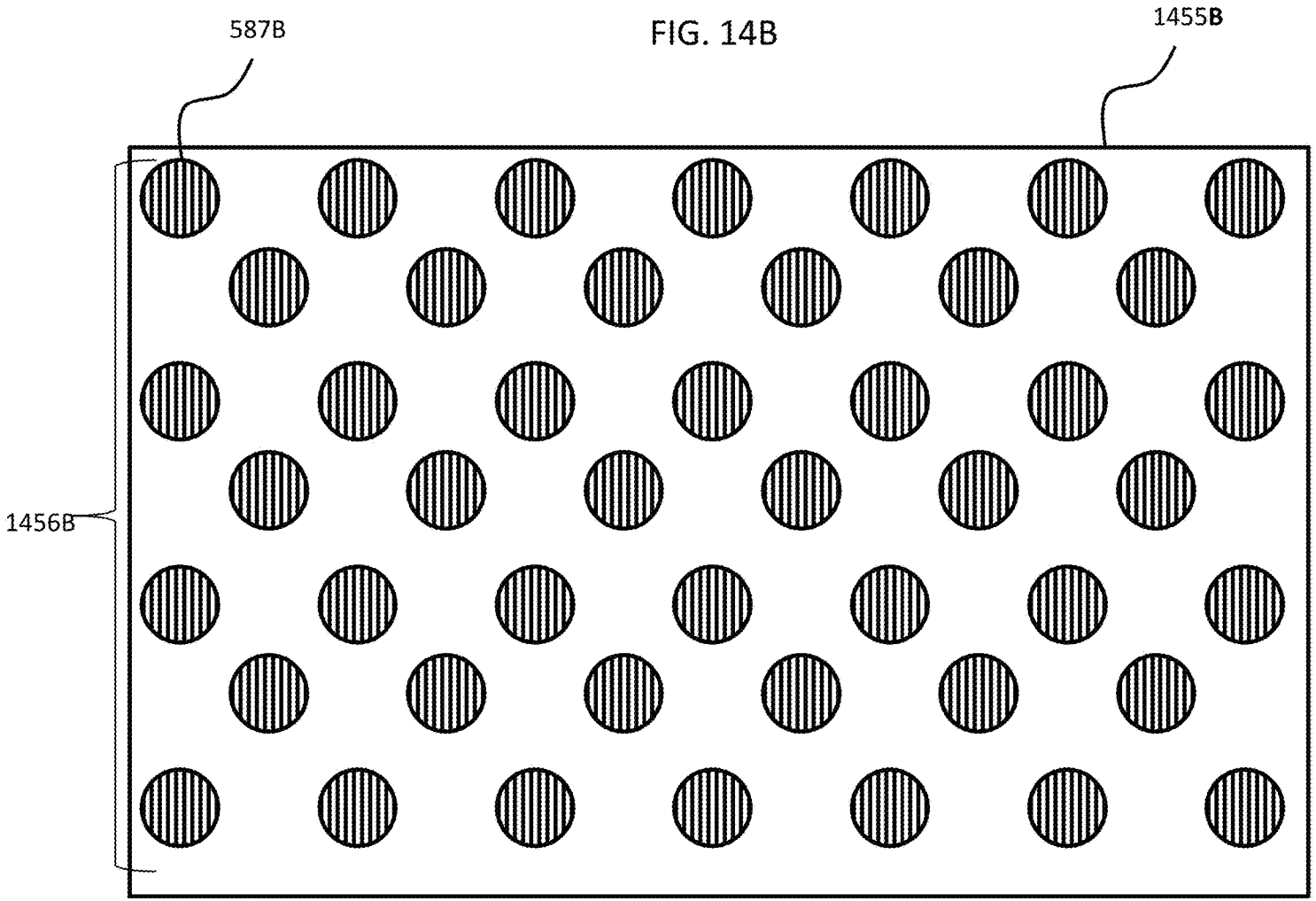
FIGS. 14B and 14C depict another exemplary embodiment of a portion of the BTE device.
Figure 14C:
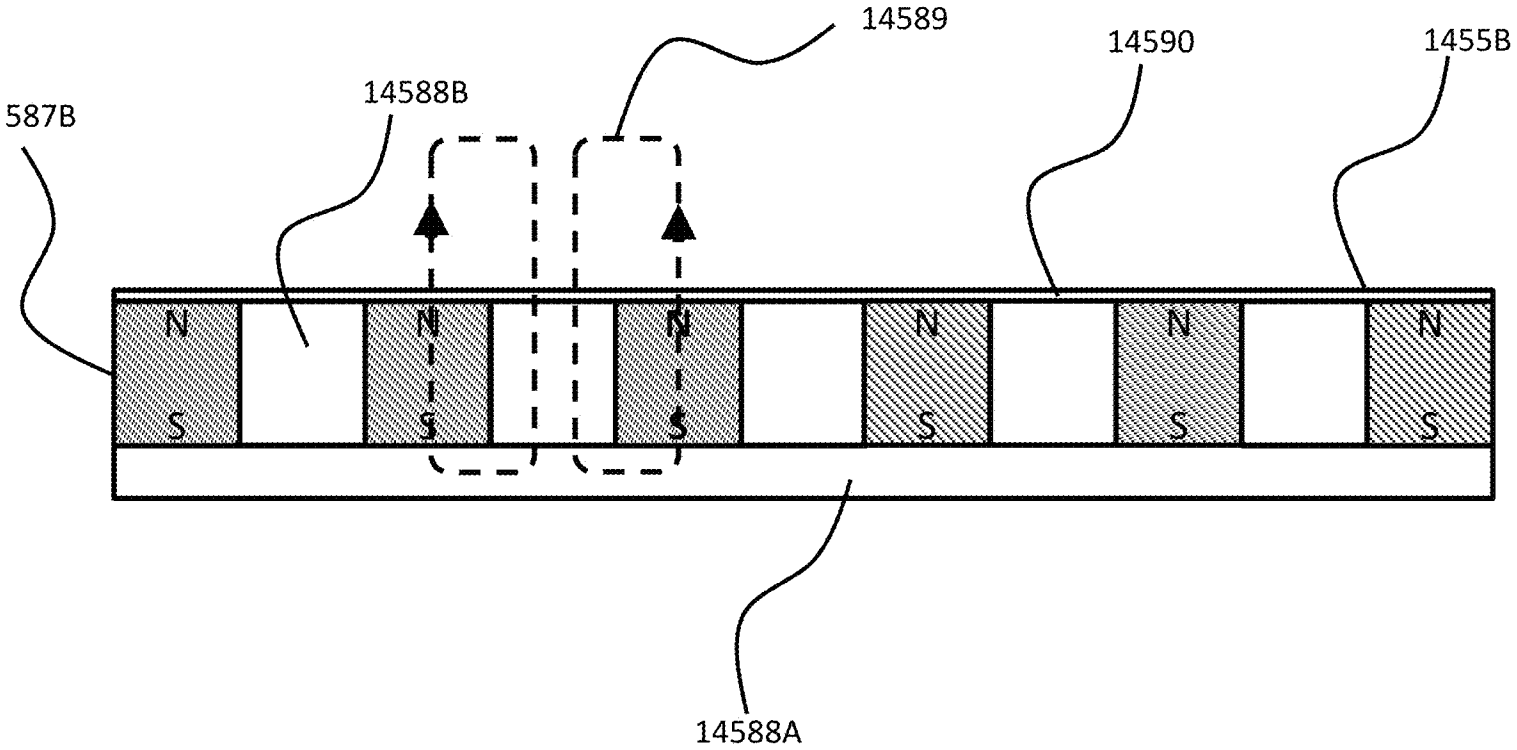

The array 1256 of FIG. 12 utilizes magnets having alternate poles arranged in a checkerboard manner. In an alternate embodiment, a magnet array can be utilized where the poles facing and/or making up the surface 255 are the same. FIGS. 14A, 14B and 14C present such an arrangement. For example, FIG. 14A presents an array 1456A of magnetic poles 587B where the north poles of all of the magnets are closest to and/or forms the surface 1455A (corresponding to surface 255). It is noted that in alternative embodiment, an alternate array of magnetic poles can be such that the south poles of all of the magnets are closest to and/or forms the vibration transfer surface of the BTE device. In the embodiment of FIG. 14A, the density of the magnetic poles per area corresponds to that of the embodiments of FIG. 12. However, in an alternate embodiment, the density may be reduced size to provide "room" between the magnets for the magnetic flux of each magnet to return to the south pole thereof without substantially and/or effectively interacting with the magnet bodies of adjacent magnets. FIG. 14B presents such an exemplary array 1456B, where every second magnet has been removed relative to that of array 1456A. FIG. 14C presents a side view of a cross-section through FIG. 14B. As can be seen, permanent magnets 587B are spaced apart from one another, and supported by plate 14588A which can be made of soft magnetic material, such as soft iron, or non-magnetic material. In the embodiment of FIG. 14C, soft iron filler material 14588B is located between the magnets. This can have utilitarian value in channeling the respective magnetic fluxes generated by the magnets 587B between the magnets, and can be utilitarian in that it can reduce magnetic stray fields that might otherwise stray into the BTE device and interfere with some components therein, such as the actuator 242 or other electronic components (e.g., a sound processor). The material 14588B can be non-magnetic in alternate embodiments. It is noted that plate 14888A is optional in some embodiments.

Also as can be seen, surface 1455B, corresponding to surface 255, is established by a coating or plate 14590 over the north poles of the magnets (and the filler material 14588B, if present). In an exemplary embodiment, coating 14590B is a non-magnetic material that effectively and/or substantially does not interfere with the magnetic fluxes 14589 of the magnets (e.g., the fluxes can extend above the surface 1455B to extend into and past surface 399 of the vibration conductor that is in contact with the surface 1455B).

Again, the north poles of all of the magnets are closest to and/or form the surface 1455B (corresponding to surface 255), and, in an alternative embodiment, the magnets are arranged such that it is the south poles instead of the north poles that are closest to and/or forming the surface 1455B.

It is noted that in an exemplary embodiment, the magnet array structure can be configured in a curved manner, including a complex curved surface, or can be formed in a flat manner, or a combination thereof. Any surface geometry that can enable the teachings detailed herein and/or variations thereof to be practiced can be utilized to practice at least some embodiments.

In view of the above, an exemplary embodiment includes a prosthesis including an external component, such as the BTE device 240, configured to output a signal in response to an external stimulus and conductor component, such as the percutaneous or transcutaneous vibration conductor 350 or 750 respectively, coupled to the external component configured to communicatively transfer the signal at least one of to a location at or below skin of the recipient. In the exemplary embodiment of this prosthesis, the conductor component is coupled to the external component via a sliding coupling. In an exemplary embodiment, the sliding coupling is achieved utilizing the magnet array detailed herein and/or variations thereof. More specifically, the sliding coupling can include an array of magnetic poles arrayed about a side of the external component that establishes a magnetic coupling between the external component and the conductor component. In an exemplary embodiment, the poles are arrayed in an alternating manner about the side of the external component.

As noted above, the magnet array can be located on one side of the BTE device 240, or on both sides of the BTE device. That is, an exemplary embodiment includes a left/right compatible BTE device, which includes a first array of magnets arrayed about a first side of the BTE device (e.g., with respect to FIG. 2B, the right side), and includes a second array of magnets arrayed about a second side of the BTE device opposite to the first side (e.g., with respect to FIG. 2B, the left side). The respective arrays can make up or otherwise establish the respective vibration transfer surfaces 255 of FIG. 2B, and can form the underlying portion of the vibration transfer surfaces 255. In this exemplary embodiment, the respective arrays of magnets establishes a magnetic coupling between the BTE device and the conductor component when the conductor component is proximate the respective array of magnets. The word "proximate" covers a configuration where the conductor component (e.g., surface 399) directly contacts the magnets or directly contacts a thin material covering the magnets, the thin material establishing the surface(s) 255.

As noted above, an exemplary embodiment of a prosthesis can be configured such that the sliding coupling and the torque-free coupling are both present. That said, an exemplary embodiment can utilize each of these features individually. Moreover, the configurations related to enabling the sliding coupling embodiment can also enable a utilitarian feature thereof that does not utilize the sliding per se. Accordingly, an exemplary embodiment includes a prosthesis including an external component, such as BTE device 240, including a first side (e.g., the left or right side of the spline 230 of FIG. 2B) configured to output a signal (e.g., vibration) in response to an external stimulus (e.g., ambient sound) and a conductor component (e.g., the percutaneous vibration conductor and where the transcutaneous vibration conductor) coupled to the external component configured to communicatively transfer the signal at least one of to a location at or below skin of the recipient. In this exemplary embodiment, the prosthesis is configured such that the conductor component can be coupled to the external component at least one of in a plurality of locations on the first side or in a plurality of orientations at a given location on the first side.

Figure 15:
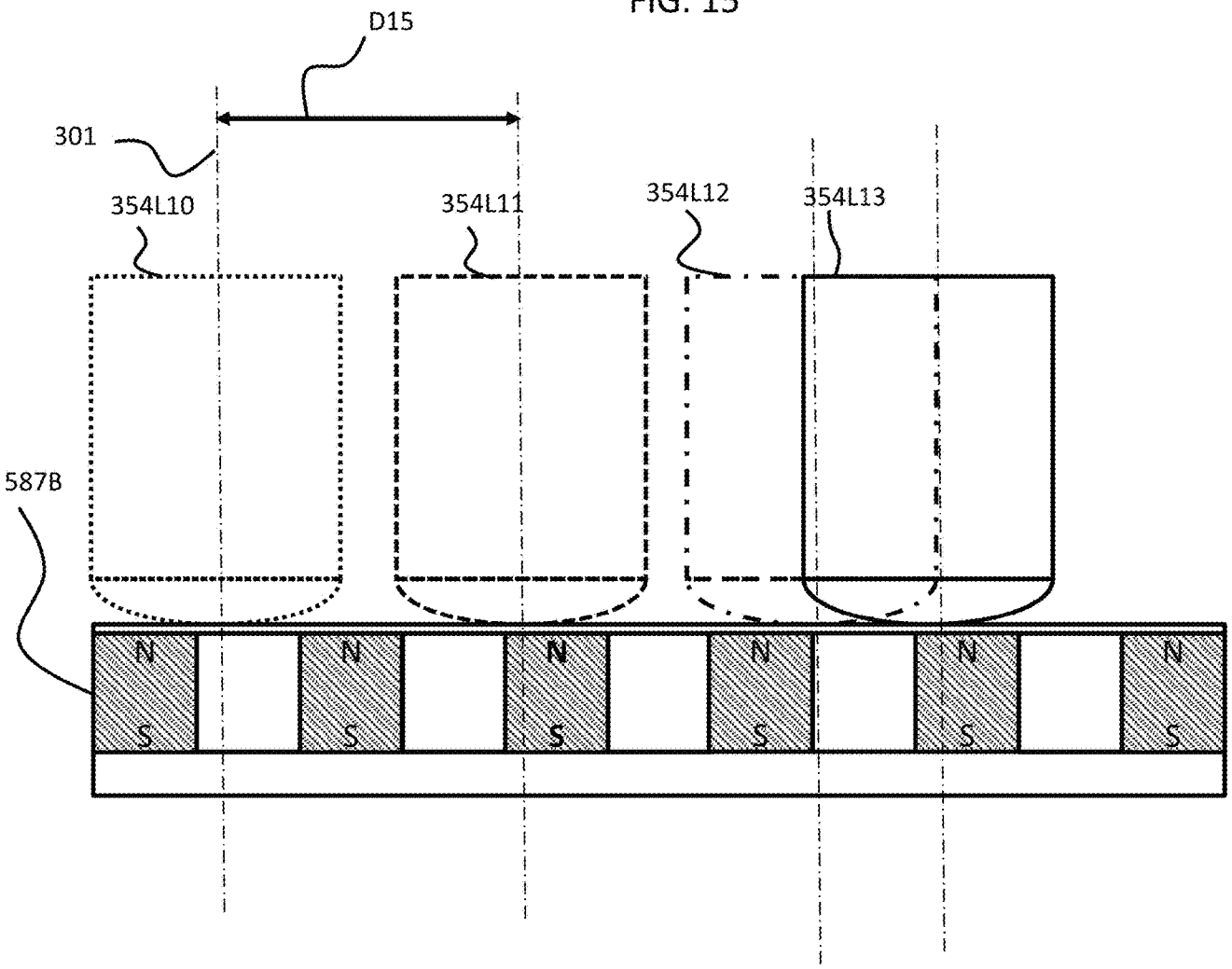
FIG. 15 depicts exemplary locations where a vibration conductor can be coupled to a BTE device.

With respect to the embodiment where the conductor component can be coupled to the external component in a plurality of locations on the first side of the external component, an exemplary embodiment entails utilizing the magnet arrays detailed herein to achieve such coupling. FIG. 15 duplicates the embodiment of FIG. 14C, except depicts various shafts of the vibration conductor at various locations 354L10, 354L11, 354L12 and 354L13. This is an example of how the magnet arrays can be utilized to provide a configuration where the conductor component can be coupled to the external component in a plurality of locations on the first side of the external component.

FIG. 15 depicts longitudinal axes 301 of the shaft 352 at different locations. As can be seen, arrow D15 represents the distance between the longitudinal axes of the shaft 352 between one position and the other. In an exemplary embodiment, the plurality of locations can be within an inch of one another (D15=1 inch). In an exemplary embodiment, the plurality of locations can be within a half inch of one another (D15=½ inch). In an exemplary embodiment, the plurality of locations can be within a quarter inch of one another (D15=¼ inch). In an exemplary embodiment, D15 can be any distance between about and including 0.01 inches to about 1.0 inches in 0.01 inch increments (e.g., 0.1 inches, 0.22 inches, about 0.02 inches to about 0.95 inches, etc.). In an exemplary embodiment, there can be more than 1, 2, 3, 4, 5, 6, 7, 8, 9, 10, 11, 12, 13, 14, 15, 16, 17, 18, 19 or 20 or more locations along a vector spanning D15.

Figure 16:
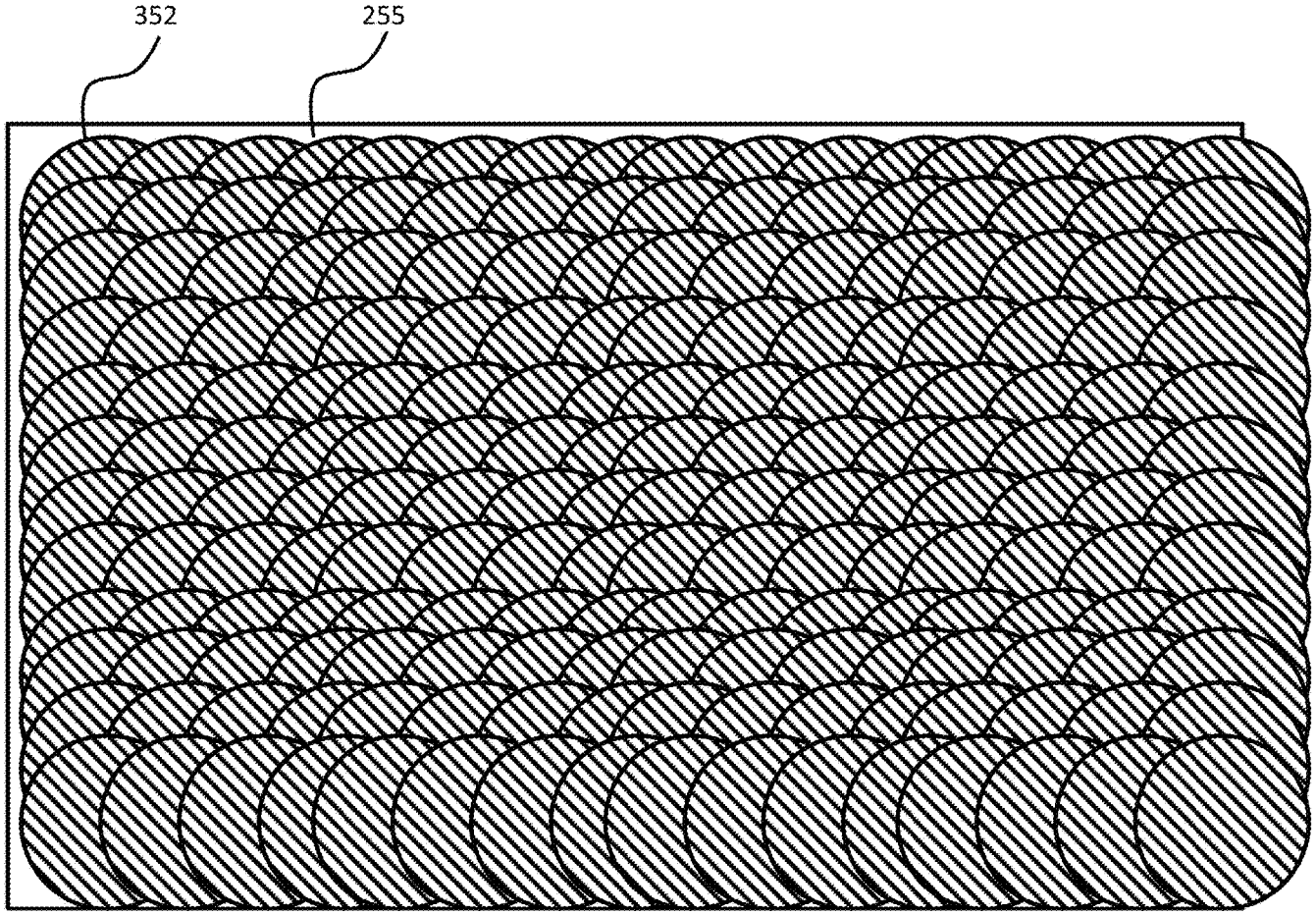
FIG. 16 depicts additional exemplary locations where a vibration conductor can be coupled to a BTE device.

In alternate terms, an exemplary embodiment includes a configuration where the conductor component can be coupled to the external component in a plurality of locations on the first side of the external component within a defined area centered at a given location. In this regard, FIG. 16 presents a top-view of surface 255 with a plurality of shafts 352 superimposed thereon (the cross-sections of the shafts being depicted in the FIG.). In the embodiment of FIG. 16, surface 255 has a length of about 1 inch and a height of about ½ inch (the height corresponding to the vertical direction in the FIG., and the length corresponding to the horizontal direction of the FIG.). This corresponds to an area of 0.5 square inches. In the embodiment depicted in FIG. 16, there are 192 positions for the shaft 352, and thus the vibration conductor, to be coupled to the BTE on that given side. Accordingly, there are 384 locations per square inch of surface area of surface 255. In an exemplary embodiment, the prosthesis is configured such that there are more than 1, 2, 3, 4, 5, 6, 7, 8, 9 or 10 locations on the surface 255 where the shaft can be coupled to the BTE device. In an exemplary embodiment, a given side of a BTE device or other prosthesis can be configured with more than a number of locations corresponding to any integer between 1 and 1000 in an area no more than a half of a square inch of vibration transfer surface 255 on a given side or any range of values therebetween (e.g., more than 2, more than 3, more than 20, more than 111, between 13 and 456 locations per square inch, etc.).

An exemplary feature of at least some of the couplings detailed herein is that a coupling force is present at the plurality of different coupling locations. Indeed, in an exemplary embodiment, the coupling is such that the conductor component can move in a lateral direction along a side of the external component (e.g., along surface 255) while maintaining an effective coupling attraction while sliding (e.g., a coupling attraction that can enable vibrations to be transferred from the BTE device to the vibration conductor to evoke a hearing percept). In an exemplary embodiment of at least some of the couplings detailed herein is that a substantially uniform coupling force is present at the plurality of different coupling locations. In an exemplary embodiment, the magnitude of coupling force at a given location is within 25% of that of the magnitude of the coupling force at another location. In an exemplary embodiment, the magnitude of the coupling force at a given location is within about 0% to 33% or any value or range of values therebetween in about 1% increments (e.g., within 5%, 7%, 10%, etc.).

In at least some exemplary embodiments, the magnetic arrays detailed herein can provide a generally uniform holding force over a given area. By way of example only and not by way of limitation, in an exemplary embodiment, a magnitude of a holding force at a first location and a second location separate from the first location within an area from 0.01 square inches to about 0.5 square inches or any value or range of values therebetween in 0.001 square inch increments is within 1%, 2%, 3%, 4%, 5%, 6%, 7%, 8%, 9% or 10% of each other. In an exemplary embodiment, a magnitude of a holding force at a plurality of locations (including all locations), such as between 1 and 100 locations or any value or range of values therebetween, between a first location and a second location separate from the first location across a vector between the two locations extending no more than an inch or no more than a half an inch or any value or range of values therebetween in 0.001 inch increments is within 1%, 2%, 3%, 4%, 5%, 6%, 7%, 8%, 9% or 10% of each other.

It is noted that in exemplary embodiments where the different connection locations are achieved by sliding, the aforementioned magnitudes can be achieved at all locations along the trajectory of sliding between the first location and the second location.

It is noted that in at least some embodiments, the holding force utilizing the magnet array and or other magnet configurations (e.g., the sliding features can also be achieved using the magnet arrangements of, for example, FIGS. 5A-5C, at least in a non-array manner). In at least some embodiments, the holding force is relatively strong when the contact surface of the vibration conductor is located against the vibration transfer surface of the BTE device, but the forced detainees relatively quickly with increasing size of the air gap between the two components.

It is noted that the above detailed coupling force features are also applicable to embodiments where the vibration conductor can rotate relative to the vibration transfer surface. By way of example only and not by way of limitation, in an exemplary embodiment, a magnitude of a holding force at a first location over a range of relative orientations corresponding to ranges of angles of the longitudinal axis of the vibration conductor relative to a tangent plane of the vibration transfer surface at the location where the two components are coupled (i.e., with reference to FIG. 4B, angle A1) is within 1%, 2%, 3%, 4%, 5%, 6%, 7%, 8%, 9% or 10% of each other, where the angular range of angles relative to the tangent plane corresponds to angles between and including 90 degrees (axis 301 directly normal with the tangent surface) to and including 55 degrees or any value or range of values therebetween in 1 degree increments. It is noted that this coupling feature can also be present for an angular range lying on a plane that is offset and angled (e.g., normal to) the plane of this example (e.g., a plane angled relative to the plane of FIG. 4B). In this regard, an exemplary embodiment includes a device configured such that a magnitude of a magnetic holding force of a magnetic coupling at a given location over a range of orientations of the conductor component spanning an angle of more than 5 degrees, 10 degrees, 15, 20, 25, 30, 35, 40, 45, 50, 55, 60 or 65 degrees or more or any value or range of values therebetween in 1 degree increments relative to a direction normal to a tangent surface at the given location is within 1%, 2%, 3%, 4%, 5%, 6%, 7%, 8%, 9% or 10% at all locations within that angular range.

It is noted that the above movements (sliding and rotation) are achieved in at least some embodiments without a component that is mechanically linked to another component. By mechanically linked, it is meant a link where a component must be moved in a direction or manner different from the direction of separation so as to separate the two components (e.g., unscrewing, elastically deforming a snap coupling, etc.). Indeed, in this regard, the above movements are achieved via a coupling where there is no positive retention between the BTE device and the vibration conductor. In an exemplary embodiment, the above movements are achieved via configuration that does not include a gimbaling component that is mechanically linked to the prosthesis. Moreover, in an exemplary embodiment, the above movements are achieved via a coupling where there is no portion of either the external component or the vibration conductor that envelops the other of the external component or the vibration conductor (e.g., there is no snap coupling). In an exemplary embodiment, the above couplings are achieved purely via magnetic attraction. That said, in an alternative embodiment, the above couplings are achieved via purely adhesive attraction. Still further, any device, system and/or method that will enable the teachings detailed herein and/or variations thereof to be practiced with respect to the coupling can be utilized in at least some embodiments.

It is noted that any disclosure of a method action detailed herein corresponds to a disclosure of a device utilized otherwise configured to execute that method action. It is further noted that any disclosure of a device and/or system herein corresponds to a disclosure of a method of utilizing that device and/or system and/or a method of manufacturing that device and/or system.

While various embodiments of the present invention have been described above, it should be understood that they have been presented by way of example only, and not limitation. It will be apparent to persons skilled in the relevant art that various changes in form and detail can be made therein without departing from the spirit and scope of the invention. For instance, in alternative embodiments, the BTE is combined with a bone conduction In-The-Ear device. Thus, the breadth and scope of the present invention should not be limited by any of the above-described exemplary embodiments, but should be defined only in accordance with the following claims and their equivalents.

What is claimed is:

1. A device, comprising:

a prosthesis including an external component configured to output a signal in response to an external stimulus and a conductor component coupled to the external component, the conductor component being configured to communicatively transfer the signal to at least one of a location at or below skin of a recipient, wherein the conductor component is coupled to the external component via an effectively torque-free coupling, wherein the device is a bone conduction device and the external component is in direct contact with the conductor component.

2. The device of claim 1, wherein:

the conductor component is coupled to the external component via a torque-free coupling.

3. The device of claim 1, wherein:

the external component includes a first surface;

the conductor component includes a second surface;

the second surface directly contacts the first surface; and at least one of the first surface or the second surface is a curved surface.

4. The device of claim 1, wherein:

the coupling is a magnetic coupling.

5. The device of claim 1, wherein:

the conductor component is a skin penetrating component configured to communicatively transfer the signal at least partially beneath skin of the recipient.

6. The device of claim 1, further comprising:

a second conductor component, wherein the second conductor component is coupled to the external component via an effectively torque-free coupling.

7. The device of claim 1, wherein:

the external component includes a first surface;

the conductor component includes a second surface;

the second surface directly contacts the first surface; and at least one of the first surface or the second surface is a non-uniform surface.

8. The device of claim 1, wherein:

the external component is a Behind-The-Ear (BTE) device.

9. The device of claim 1, wherein:

the conductor component is not a skin penetrating component.

10. The device of claim 4, wherein:

the device is configured so that the magnetic coupling between the conductor component and the external component is located completely outside the recipient.

11. The device of claim 1, wherein:

the conductor component is devoid of permanent magnet (s).

12. The device of claim 1, wherein:

the conductor component is configured to extend from outside the skin into the skin.

13. A device, comprising:

a prosthesis including an external component configured to output a signal in response to an external stimulus and a skin contacting component configured to communicatively transfer the signal at least one of to skin of a recipient or beneath skin of the recipient, wherein the device is configured such that the skin contacting component can move in a plurality of degrees of freedom relative to the external component while in direct contact with the external component, wherein the device is a bone conduction device and the external component is in direct contact with the skin contacting component.

14. The device of claim 13, wherein:

the plurality of degrees of freedom are at least three degrees of freedom.

15. The device of claim 13, wherein:

the plurality of degrees of freedom are at least four degrees of freedom.

16. The device of claim 13, wherein:

the plurality of degrees of freedom are five degrees of freedom.

17. The device of claim 13, wherein:

the device is configured such that the skin contacting component can relatively move laterally in at least one direction along the external component while retained to the external component.

18. The device of claim 13, wherein the skin contacting component is configured to penetrate skin of the recipient from an external side of the skin of the recipient, and wherein the external component is a Behind-The-Ear (BTE) device.

19. A device, comprising:

a prosthesis including an external component configured to output a signal in response to an external stimulus and a skin contacting component configured to communicatively transfer the signal at least one of to skin of a recipient or beneath skin of the recipient, wherein the device is configured such that the skin contacting component can move in a plurality of degrees of freedom relative to the external component while retained to the external component, wherein the device is a bone conduction device; and at least one of:

the device is configured such that the skin contacting component can be coupled to the external component at more than four locations on a surface area having an area of no more than a half of a square inch on one side of the external component in a manner that will enable a vibration to be transferred from the external component to the skin contacting component to effectively evoke a hearing percept; or the device is configured such that the skin contacting component can be coupled to the external component at more than four locations on a vector along a surface of the external component that extends no more than one inch in a manner that will enable a vibration to be transferred from the external component to the skin contacting component to effectively evoke a hearing percept.

20. The device of claim 19, wherein:

the device is configured such that the skin contacting component can be coupled to the external component at more than four locations on the vector along the surface of the external component that extends no more than one inch in the manner that will enable the vibration to be transferred from the external component to the skin contacting component to effectively evoke the hearing percept.

21. The device of claim 19, wherein:

the device is configured such that the skin contacting component can be coupled to the external component at more than four locations on the surface area having the area of no more than the half of the square inch on one side of the external component in the manner that will enable the vibration to be transferred from the external component to the skin contacting component to effectively evoke the hearing percept.

22. A device, comprising:

a prosthesis including an external component configured to output a signal in response to an external stimulus and a conductor component configured to couple to the external component, the conductor component being configured to communicatively transfer the signal at least one of to a location at or below skin of a recipient, wherein the conductor component is coupled to the external component via a sliding coupling, wherein the device is a bone conduction device and the external component is in direct contact with the conductor component.

23. The device of claim 22, wherein:

the sliding coupling includes an array of magnetic poles arrayed in an alternating manner about a side of the external component that establishes a magnetic coupling between the external component and the conductor component.

24. The device of claim 22, wherein:

the sliding coupling includes an array of magnets arrayed about a side of the external component that establishes a magnetic coupling between the external component and the conductor component.

25. The device of claim 22, wherein:

the external component is a BTE device; and the conductor component is a skin penetrating component configured to communicatively transfer the signal at least partially beneath skin of the recipient.

26. The device of claim 22, wherein:

the external component is a left/right compatible BTE device;

the external component includes a first array of magnets arrayed about a first side of the BTE device;

the external component includes a second array of magnets arrayed about a second side of the BTE device opposite to the first side, wherein the respective arrays of magnets establishes a magnetic coupling between the BTE device and the conductor component when the conductor component is proximate the respective array of magnets.

27. The device of claim 22, wherein:

the sliding coupling is configured such that the conductor component can move in a lateral direction along a side of the external component while maintaining substantially the same coupling attraction between the conductor component and the external component with respect to the movement in the lateral direction.

28. The device of claim 22, wherein:

the conductor component is configured to penetrate skin of the recipient from an external side of the skin of the recipient, and wherein the external component is a Behind-The-Ear (BTE) device.

29. A device, comprising:

a prosthesis including an external component including a first side configured to output a signal in response to an external stimulus and a conductor component configured to couple to the external component, the conductor component being configured to communicatively transfer the signal at least one of to a location at or below skin of a recipient, wherein the device is configured such that the conductor component can be coupled to the external component at least one of in a plurality of locations on the first side or in a plurality of orientations at a given location on the first side, wherein the device is configured such that the coupling is a magnetic coupling, the device is configured such that, at a given location of the device, the conductor component can have a plurality of angular orientations over a range of angular orientations of the conductor, respective orientations over the range being defined by an angle between a longitudinal axis of the conductor and a direction normal to a tangent surface of the device at the given location, the range is more than 35 degrees, and respective magnitudes of magnetic holding forces of the magnetic coupling at the given location for all orientations of the conductor over the range of orientations have respective values that differ by 10% or less.

30. The device of claim 29, wherein:

the device is configured such that the conductor component can be coupled to the external component at the plurality of locations on the first side with a substantially uniform coupling force at the plurality of locations.

31. The device of claim 29, wherein:

the device is configured such that the conductor component can be coupled to the external component at the plurality of orientations at the given location on the first side with a substantially uniform coupling force at the plurality of orientations.

32. The device of claim 29, wherein:

the device is a percutaneous bone conduction device; and the conductor component is a skin penetrating component configured to communicatively transfer the signal at least partially beneath skin of the recipient.

33. The device of claim 32, wherein:

the external component and/or the skin penetrating component includes a permanent magnet, and the external component and/or the skin penetrating component includes a surface having contours configured to permit the skin penetrating component to be coupled to the external component at least one of in the plurality of locations on the first side or in the plurality of orientations at the given location on the first side.

34. The device of claim 29, wherein:

the device is configured such that the conductor component can be coupled to the external component at the plurality of locations on the first side;

the device is configured such that the conductor component can slide along a surface of the external component from a first coupling location to a second coupling location; and the device is configured to maintain the coupling along a trajectory of sliding of the conductor component from the first location to the second location.

* * * * *